US012650240B2

(12) United States Patent
Facemyer

(10) Patent No.: US 12,650,240 B2
(45) Date of Patent: Jun. 9, 2026

(54) METHODS AND APPARATUS FOR IMPROVED ROOFTOP UNITS FOR HEATING VENTILATION AND AIR CONDITIONING SYSTEMS

(71) Applicant: Clauger USA, LLC, Jacksonville, FL (US)

(72) Inventor: Luke T. Facemyer, St. Johns, FL (US)

(73) Assignee: Clauger USA, LLC, Jacksonville, FL (US)

( * ) Notice: Subject to any disclaimer, the term of this patent is extended or adjusted under 35 U.S.C. 154(b) by 99 days.

(21) Appl. No.: 18/781,249

(22) Filed: Jul. 23, 2024

(65) Prior Publication Data

US 2025/0207810 A1 Jun. 26, 2025

Related U.S. Application Data

(60) Provisional application No. 63/613,017, filed on Dec. 20, 2023.

(51) Int. Cl.
*F24F 13/20* (2006.01)
*F24F 13/22* (2006.01)
(Continued)

(52) U.S. Cl.
CPC ..... *F24F 13/20* (2013.01); *F24F 13/222* (2013.01); *F24F 2110/10* (2018.01);
(Continued)

(58) Field of Classification Search
None
See application file for complete search history.

(56) References Cited

U.S. PATENT DOCUMENTS 6,763,670 B1 * 7/2004 Bushnell ..... B60H 1/00542 62/200
2012/0288718 A1 * 11/2012 Takano ..... C08G 18/672 252/589

(Continued)

FOREIGN PATENT DOCUMENTS

CN 111578419 A * 8/2020 ..... F24F 5/0046

OTHER PUBLICATIONS

For1, A Central Air-conditioning Main Machine of Geothermal Energy and Central Air-conditioning System of Geothermal Energy, 2020, Full Document (Year: 2020).*

*Primary Examiner* — Nael N Babaa
(74) *Attorney, Agent, or Firm* — Tracnik Law, LLC; Joseph P Kincart

(57) ABSTRACT

Improved apparatus and methods of an innovative Lightweight Roof Top Unit (LRTU) for housing HVAC systems, focusing on enhanced operational efficiency, ease of maintenance, and improved environmental adaptability. The core of the LRTU is constructed from Polypropylene Random Copolymer (PPR), providing a durable yet lightweight foundation. This core is supplemented by one or more protective layers, which may include metallic, non-metallic, or nanocomposite materials, providing robust protection against environmental stressors. The LRTU offers modular construction for easy assembly, disassembly, and maintenance, adapting to various building and transportation requirements. An integrated control system equipped with sensors monitors and regulates internal conditions such as temperature, humidity, air quality, and pressure, ensuring optimal performance. Advanced features may include an economizer for energy-efficient cooling, integrated solar panels for auxiliary power generation, rainwater harvesting, smart tech-
(Continued)

nology interfaces for remote monitoring and control, and an advanced air filtration system with HEPA filters.

22 Claims, 18 Drawing Sheets

(51) Int. Cl.
*F24F 110/10* (2018.01)
*F24F 110/20* (2018.01)
*F24F 110/40* (2018.01)
*F24F 110/50* (2018.01)

(52) U.S. Cl.
CPC ..... *F24F 2110/20* (2018.01); *F24F 2110/40* (2018.01); *F24F 2110/50* (2018.01); *F24F 2221/16* (2013.01); *F24F 2221/22* (2013.01); *F24F 2221/36* (2013.01)

(56) References Cited

U.S. PATENT DOCUMENTS

| | | | | |
|---|---|---|---|---|
| 2015/0285516 | A1* | 10/2015 | Hanks | F24F 13/20 29/428 |
| 2018/0058539 | A1* | 3/2018 | Threadgold | F16F 15/04 |
| 2018/0340704 | A1* | 11/2018 | Turney | G05B 13/048 |
| 2019/0234649 | A1* | 8/2019 | Phillips | F24F 11/30 |
| 2020/0284447 | A1* | 9/2020 | Brubaker | F24F 13/20 |
| 2021/0131681 | A1* | 5/2021 | Duncan | F24F 11/85 |
| 2022/0049856 | A1* | 2/2022 | Chiba | F16L 13/02 |

* cited by examiner

METHODS AND APPARATUS FOR IMPROVED ROOFTOP UNITS FOR HEATING VENTILATION AND AIR CONDITIONING SYSTEMS

CROSS REFERENCE TO RELATED APPLICATIONS

This application claims the benefit of U.S. Provisional Patent Application 63/613,017, filed on Dec. 20, 2023, and entitled METHODS AND APPARATUS FOR IMPROVED ROOFTOP UNITS FOR HEATING VENTILATION AND AIR CONDITIONING SYSTEMS, the entire disclosure of which is incorporated herein by reference.

FIELD OF THE DISCLOSURE

The present disclosure relates to methods and apparatus for improved heating, ventilation and air conditioning ("HVAC") roof top units that are lightweight, durable, and require a lower carbon footprint to implement. More specifically, the present invention provides a lightweight roof top unit (LRTU) that incorporates advanced materials and design features to enhance efficiency, ease of maintenance, and environmental adaptability. The LRTU employs a novel use of Polypropylene Random Copolymer (PPR) as a core material, combined with various protective and insulative layers, and is characterized by a modular, and in some embodiments, tubular design, that optimizes airflow and structural stability.

BACKGROUND OF THE DISCLOSURE

The construction industry consumes vast amounts of materials, including natural resources like wood, minerals, and water. On a regional basis and eventually, a global basis, the consumption of natural resources eventually leads to resource depletion, if not managed sustainably. Buildings account for a considerable portion of the total energy consumption, especially in developed countries. This energy consumption includes energy used in building construction in the manufacture of equipment that is incorporated into a building deployed for operation.

In addition, construction machinery and the production of building materials contribute to air pollution, including greenhouse gas emissions, which are often targeted in environmental protection initiatives. Even factors such as construction site production of noise and dust (which can be a nuisance and health hazard for local communities) have become topics of interest and management. Also, the transportation of materials and equipment to construction sites can have a considerable environmental footprint, particularly in terms of emissions. Generally, the heavier building materials are, and the further they must be transported (combined with how they are transported), the more energy is consumed in transporting the materials and equipment to the respective construction sites.

Consequently, the construction industry has an opportunity to improve its impact on the degradation of the environment. Standards such as LEED (Leadership in Energy and Environmental Design) encourage the construction industry to adopt sustainable practices that can mitigate its environmental impact. LEED is a green building certification program developed by the U.S. Green Building Council (USGBC). LEED includes a set of rating systems for the design, construction, operation, and maintenance of green buildings, homes, and communities.

Buildings can earn different levels of certification based on a number of points the building achieves in various categories. Various LEED designations include:

Certified: based upon a building earning 40-49 points;
Silver: based upon a building earning 50-59 points;
Gold: based upon a building earning 60-79 points; and
Platinum: based upon a building earning 80+ points.

The categories in which these points can be achieved include one or more of: Sustainable Sites; Water Efficiency; Energy and Atmosphere; Materials and Resources; Indoor Environmental Quality; Innovation in Design; and Regional Priority.

LEED promotes sustainability by encouraging designs that: use less water and energy; reduce greenhouse gas emissions; improve indoor environmental quality; and create a healthier and safer environment for occupants.

A Rooftop Unit (RTU), is a type of HVAC (Heating, Ventilation, and Air Conditioning) system that is typically mounted outside of a commercial building, such as on a roof of the commercial building or multi-family residential building. RTUs can provide heating, cooling, and ventilation to the space below. RTU is typically housed in its own metal housing or casing (or cabinet) that is specifically constructed to withstand external environmental conditions since it's located on a building's roof. The housing or casing contains major components of the HVAC system and protects the major components from weather, debris, and potential damage. The housing or casing of an RTU is typically manufactured from galvanized steel or other heavy material with an energy-intensive manufacturing process. The galvanized steel often includes multiple panels and may be fashioned into several compartments. The housing will have air intake portions and outlet portions.

Energy involved in the manufacture, transportation, and installation on the top of a commercial building of such large heavy, galvanized steel items, such as an RTU, involves a significant amount of energy and a consequential carbon footprint. The structural strength that is required to support the heavy weight of a traditional RTU is also significant and may further add to detrimental aspects of a LEED rating.

In light of these challenges, there is a growing need within the industry to develop and implement solutions that not only minimize environmental impact but also align with the evolving sustainability standards like LEED. The focus is increasingly shifting towards creating materials and systems that are not only efficient in their use but also contribute to the overall reduction of the carbon footprint of buildings. This shift includes rethinking the materials and construct of building components such as HVAC systems, particularly Roof Top Units (RTUs), to make them more eco-friendly.

The construction industry, particularly in the area of HVAC systems, is in need of options to pursue a paradigm shift towards sustainability.

SUMMARY OF THE DISCLOSURE

The present invention provides methods and apparatus for reducing one or both of: the weight and carbon footprint associated with a RTU suitable to contain HVAC components for maintaining atmospheric conditions within a large building. In some embodiments of the invention, a Lightweight Roof Top Unit (LRTU) is provided with a LRTU exterior (e.g., a housing) primarily constructed from a synthetic material, such as, by way of non-limiting example, Polypropylene Random Copolymer (PPR), a material chosen for its lightweight yet robust characteristics. Other synthetic materials that are relatively lightweight (as compared to galvanized steel or other metals) may also be used to construct the housing and chosen based upon environmental conditions of a geolocation in which the LRTU will be deployed. To fortify a lightweight synthetic material housing, PPR (or other synthetic material) may be coated with a protective layer, which may be either a thin layer of galvanized steel (as compared to a housing formed primarily of galvanized steel) or a high-grade impervious plastic. This outer coating is constructed to withstand adverse weather conditions, such as heavy rainfall, snow, intense sunlight, and temperature extremes.

In some configurations, a LRTU may include a dual-layered approach wherein PPR (or other synthetic material) is sandwiched between two protective coatings. PPR bordered by two protective coatings not only offers an external shield against environmental factors, but also enhances an internal stability of the LRTU. For example, an outer layer may be a corrosion-resistant alloy in coastal areas to combat saltwater damage. A layer of UV-reflective material may be used in sunnier climates to prevent degradation due to UV exposure. Additionally, an outer surface may also feature a finish to minimize dust and debris accumulation, maintaining the unit's efficiency and reducing cleaning requirements, such as a texture.

Some embodiments of the invention may include methods for manufacturing the LRTU and adapting to the varying sizes and complexities of its components. Larger sections of the unit may be created through an extrusion process, where PPR is extruded onto a thin layer of galvanized steel, ensuring uniformity and structural integrity for these substantial parts. This method is particularly efficient for producing large panels or sections that form the main body of the unit. On the other hand, smaller, more intricate components are either injection molded, or 3D printed, methods ideal for achieving high precision and complexity in construct. These smaller parts are then coated with a metallic layer post-manufacturing. The type of metal used for coating can be varied based on environmental needs; for example, rust-resistant metals are ideal in humid regions, while metals with high thermal emissivity are preferable in hotter areas. The manufacturing process may also embrace advanced techniques like selective laser sintering for parts that require additional strength, and modular designs in larger components to facilitate easier transportation and assembly.

In some embodiments of the present invention, a Lightweight Roof Top Unit (LRTU) is provided that is able to optimize thermal efficiency for a given geolocation and deployment to control atmospheric conditions for specified purposes. For example, a LTRU may be deployed in a first instance in a warmer climate geolocation as a cooling unit of a cold storage and include materials and insulation to achieve these deployment objectives and deployed in a second instance in a cooler environment as a heating and cooling unit for residential and/or office space. The LRTU may, in some embodiments incorporate advanced insulation materials within its PPR structure, minimizing thermal transfer. The advanced insulation is especially beneficial in extreme climates, where maintaining internal temperature is crucial. The insulation is tailored to retain heat in colder environments and reflect heat in warmer climates, thereby reducing the energy load on the HVAC system and further contributing to the unit's eco-friendly profile. The insulation may not be just a passive layer; it may be actively tailored to adapt to the environmental needs of its location. In colder environments, where heat retention is key, the insulation is constructed to trap warmth within the unit, thus reducing the need for continuous heating and, consequently, lowering energy consumption. This can be achieved through a denser composition of the insulation materials, which are selected for their high thermal resistance and ability to prevent heat escape.

Conversely, in warmer climates, the insulation may take on a different role. In climates where it is desirous to control heat, the LTRU may be engineered to reflect heat, thereby preventing the internal temperature of the unit from rising due to external heat sources. Reflective capability is helpful in minimizing the cooling requirements of the HVAC system, also leading to a significant reduction in energy usage. Dynamic and responsive insulation systems allow an LRTU solution to be a versatile, climate-conscious innovation. Climate adaptation enhances energy efficiency of the LRTU system and contributes to the overall eco-friendly profile of the LRTU.

By reducing the energy load required to maintain optimal temperatures, the LRTU demonstrates a commitment to sustainability. It addresses the growing need for environmentally responsible solutions in building infrastructure, particularly in a world where energy efficiency and climate adaptability are becoming increasingly important. The LRTU, through its intelligent construct and advanced material use, may set a new standard in rooftop HVAC units, combining practical functionality with environmental stewardship.

In other embodiments, the LRTU may include integrated solar panels on its surface. These panels are lightweight and conform to the unit's construct, providing an auxiliary power source for the HVAC system. This feature not only reduces the unit's reliance on external power sources but also aligns with the goal of reducing the carbon footprint. The solar panels may be made from high-efficiency photovoltaic cells, optimized for performance even in low-light conditions. These cells may be meticulously engineered to capture sunlight and convert it into electrical energy with high efficiency. What sets these cells apart is their optimized performance in a variety of lighting conditions. Unlike conventional solar cells, which may falter in low-light scenarios, the photovoltaic cells on the LRTU may be effective even under overcast skies or during the low-light periods of early morning and late evening. This capability facilitates a more consistent and reliable energy output, making the LRTU a practical solution in diverse geographic locations and climates.

The incorporation of solar panels directly addresses the increasing need for sustainable energy solutions in building infrastructure. By generating its own power, the LRTU reduces reliance on external power sources, which often rely on fossil fuels. This reduction is twofold beneficial: it decreases operational costs associated with powering the HVAC system and significantly lowers the carbon footprint of the building. Such an eco-friendly approach is in line with global initiatives to reduce greenhouse gas emissions and combat climate change. In essence, the solar-powered LRTU represents a harmonious blend of functionality, sustainability, and technological innovation. It stands as a testament to the potential of integrating renewable energy sources into everyday infrastructure, paving the way for a more sustainable future. This embodiment of the LRTU not only enhances the energy efficiency of the HVAC system but also contributes positively to the broader goal of environmental stewardship, making it a beacon of green technology in the field of building climate control.

Some embodiments of the apparatus may feature a rainwater harvesting system integrated into the LRTU. This system collects rainwater from the unit's surface, which is then filtered and stored for use in the building's water supply or for irrigation purposes. This feature adds to the environmental sustainability of the unit, reducing the need for external water resources and managing stormwater runoff in urban settings.

In some embodiments of the apparatus, the LRTU may be equipped with smart technology interfaces. These interfaces allow for remote monitoring and control of the unit, enabling users to optimize performance based on real-time data. This technology can adjust settings for energy efficiency, monitor the health of the unit, and provide alerts for maintenance needs. Such integration with IoT (Internet of Things) devices enhances user experience and operational efficiency. This remote accessibility is particularly advantageous for large buildings or complexes where on-site management of each unit can be logistically challenging. This smart technology goes beyond mere remote control; it may enable the LRTU to deliver real-time data about its performance and condition. This feature may be instrumental in optimizing the unit's performance for energy efficiency. Users can adjust settings such as temperature and airflow, based on real-time feedback, ensuring the unit operates at peak efficiency while minimizing energy consumption. This adaptability not only leads to cost savings but also aligns with environmental sustainability goals. This may continuously analyze the functioning of the LRTU, detecting potential issues before they escalate into major problems. Users receive alerts for regular maintenance or urgent repair needs, enabling proactive management of the unit. This pre-emptive approach to maintenance facilitates reliable operation of the LRTU over its lifespan, reducing downtime and avoiding costly emergency repairs. The integration of smart technology interfaces transforms the LRTU into a highly intelligent, responsive, and efficient system. This integration may also represent a significant stride toward the future of smart building management, where convenience, efficiency, and sustainability converge.

In some innovative versions of the LRTU, a significant emphasis may be placed on enhancing indoor air quality through the incorporation of an advanced air filtration system. This system is a critical component in areas where air quality is compromised, such as urban environments with high pollution levels. Central to this system are HEPA filters, renowned for their ability to trap a vast majority of airborne particles, including pollutants, allergens, and dust. These filters are part of a broader high-efficiency filtration technology that is integrated into the LRTU, ensuring that the air circulated within the building is not only cool or warm but also clean and healthy. The benefits of such a filtration system are manifold. In urban settings, where outdoor air quality can be poor due to traffic and industrial emissions, the LRTU's advanced filtration is helpful to provide indoor air that is significantly purer. This is particularly beneficial for individuals with respiratory issues or allergies, as the system effectively removes irritants and pollutants from the air. Moreover, in any enclosed space, the quality of air directly impacts the health and well-being of its occupants, making this feature a valuable addition to the LRTU. Equally important is the construct of the filtration system, which is aligned with the overall user-friendly and serviceable nature of the LRTU. The filters are easily accessible, allowing for straightforward maintenance and replacement. Overall, the integration of an advanced air filtration system in the LRTU represents a thoughtful convergence of climate control and health-conscious technology, making it an ideal solution for modern, health-aware buildings.

In an embodiment of the apparatus, an LRTU for Heating, Ventilation, and Air Conditioning (HVAC) systems is presented, showcasing advanced construction and functional features. The LRTU is constructed with a core layer made from Polypropylene Random Copolymer (PPR), chosen for its durability and versatility. Affixed to this core layer is at least one protective layer, which can be a metallic layer composed of materials like aluminum or galvanized steel, a non-metallic UV-resistant polymer, high-grade impervious plastic, or a nanocomposite coating that incorporates enhanced durability and reflectivity. In some embodiments, the LRTU features a sandwich structure, where a first protective layer is applied to one side of the PPR core and a second, potentially different, protective layer is applied to the other side.

The unit's modularity can be a key aspect, with components configured for easy assembly, disassembly, and maintenance. Such embodiments allow for quick servicing and potential future upgrades. The modular components may include detachable panels with standardized connectors for efficient installation and servicing, and they are formed in sizes and shapes that are interchangeable to cater to specific building requirements.

In some embodiments, the LRTU may also include an integrated control system equipped with various sensors, including, but not limited to, temperature, pressure, humidity, and air-quality sensors. This system can operate in conjunction with a building management system (BMS), enhancing the overall efficiency and responsiveness of the HVAC setup. The control system is also capable of wireless connectivity for remote monitoring and control, adding a layer of convenience and advanced functionality.

Additional features of the LRTU may include an economizer for utilizing outside air for indoor temperature control, an integrated solar panel system for auxiliary power generation, and a rainwater harvesting system. These features may contribute to the unit's energy efficiency and environmental sustainability. A condensate drain may also be included to manage moisture from the cooling process, and a thermal insulation system adaptable to varying climatic conditions facilitates optimal operational efficiency.

For enhanced user comfort and structural compatibility, the LRTU may include a sound attenuation system within the protective layers to reduce operational noise and a vibration-damping mechanism to minimize the transmission of vibrations to the building structure. The protective layer may also comprise a self-cleaning surface, reducing maintenance requirements.

In some embodiments of the apparatus, a method to enhance the performance and durability of the PPR layer comprises incorporating advanced material technologies. One such improvement may involve the integration of nanotechnology into the PPR layer. By embedding nanoparticles or nanofillers, such as, but not limited to, carbon nanotubes or graphene, into the PPR matrix, the material can acquire substantially improved properties. These may include increased mechanical strength and thermal stability, facilitating withstanding the rigors of rooftop environmental conditions. Additionally, the inclusion of UV-resistant nanoparticles may significantly reduce degradation caused by prolonged sun exposure, thus prolonging the lifespan of the LRTU.

Further, some embodiments include application of a hydrophobic nano-coating on the PPR surface. Hydrophobic nano-coating on the PPR surface (or other lightweight synthetic panel material) provides protection against environmental elements, and facilitates rendering the LRTU highly resistant to moisture and preventing water-related damage. The hydrophobic nano-coating may also impart self-cleaning properties to the PPR layer, reducing maintenance requirements. Furthermore, the PPR layer may include multiple layers, specific layers may serve a specific function, such as thermal insulation, noise reduction, or vibration damping. Such a multifunctional approach may not only enhance the overall efficiency of the LRTU but also contribute to a more sustainable and eco-friendly HVAC solution.

In some embodiments of the apparatus, the LRTU may be enhanced with a layer of adaptive insulation, which intelligently alters its thermal resistance based on real-time temperature readings. This innovative insulation layer employs materials that can expand or contract, or otherwise change their insulating properties, in response to external temperature shifts. Such smart materials enable the LRTU to reach and maintain an internal temperature set by a user and/or a controller more efficiently by reducing the need for additional heating or cooling when external conditions are favorable. Such dynamic insulating properties adjustment capability enables the LRTU to be more energy-efficient, potentially leading to lower operational costs and reducing the environmental footprint of the LRTU operation. The adaptive insulation layer can be integrated during the manufacturing process or retrofitted into existing units, providing a versatile solution for new and upgraded HVAC systems.

In some embodiments of the apparatus, the LRTU may incorporate a layer made from advanced self-healing polymers within its core structure (PPR layer) or as part of its protective layers. These polymers may be engineered to autonomously repair minor damages such as cracks or scratches, thereby maintaining the integrity of the LRTU without the need for manual intervention. The self-healing mechanism may be triggered by environmental factors such as changes in temperature or exposure to sunlight, which activate the material's intrinsic repair response. This innovative feature significantly extends the lifespan of the LRTU, reduces maintenance costs, and facilitates continuous protection of the HVAC system's critical components from environmental exposure.

In some embodiments of the apparatus, the LRTU modular components may be constructed from biodegradable or compostable materials. Such biodegradable or compostable materials may include environmentally compatible materials selected to minimize an ecological footprint upon the end of the LRTU's service life by allowing LRTU components to break down naturally without harming the ecosystem. Use of biodegradable or compostable materials contribute to sustainable manufacturing practices and also align with green building certifications, potentially enhancing an overall environmental performance rating of a building where LRTU units are installed.

In some embodiments of the apparatus, the LRTU may be enhanced with smart surface coatings on its outermost protective layer. These advanced coatings may be engineered to change color or texture in response to fluctuations in temperature. Such thermochromic features provide a visual cue to the unit's operating condition, allowing for easy and immediate surface condition monitoring without the need for complex sensors or equipment. Such smart coatings not only serve as a diagnostic tool for maintenance personnel but also offer a way to visually ensure that the unit is functioning within its optimal temperature range, thus contributing to proactive maintenance and energy efficiency.

In some embodiments of the apparatus, the LRTU may feature modular components that allow for customizable configuration of the components. Modularity enables the LRTU to be tailored to specific building parameters, such as varying roof sizes or shapes. The ability to customize the layout of components like air intakes, exhausts, and service panels facilitates adaptability of the LRTU to a wide range of architectural designs.

Some embodiments may incorporate vibration-damping materials and designs to minimize operational noise and structural impact. This feature is particularly important in residential areas or buildings where noise reduction is a priority. The vibration damping is achieved through the strategic placement of materials within the unit's structure, ensuring that the unit operates quietly while maintaining its efficiency and durability.

In certain embodiments, the LRTU may include an aerodynamic shape to minimize wind resistance and load on the building structure. An aerodynamic size and shape is especially beneficial in high-wind areas or tall buildings, where wind load can be a significant factor. The aerodynamic size and shape may contribute to the overall efficiency of the LRTU.

Some versions of the LRTU may integrate a heat recovery system, which captures and reuses waste heat from the HVAC process. This system enhances the overall energy efficiency of the unit, reducing the energy needed to heat or cool the building. The heat recovery system may be compatible with a modular nature of an LRTU, allowing for easy integration into different unit configurations.

In another embodiment, the LRTU may include advanced humidity control feedback sensors and controller. Advanced humidity control maintains preferred indoor humidity levels, which is important for comfort and health. Humidity control may be particularly beneficial in regions with high humidity or arid climates. A Humidity Control System may work in tandem with HVAC components to provide a comfortable and healthy indoor environment, further enhancing the LRTU's appeal in diverse climatic conditions.

DETAILED DESCRIPTION

Figure 1:
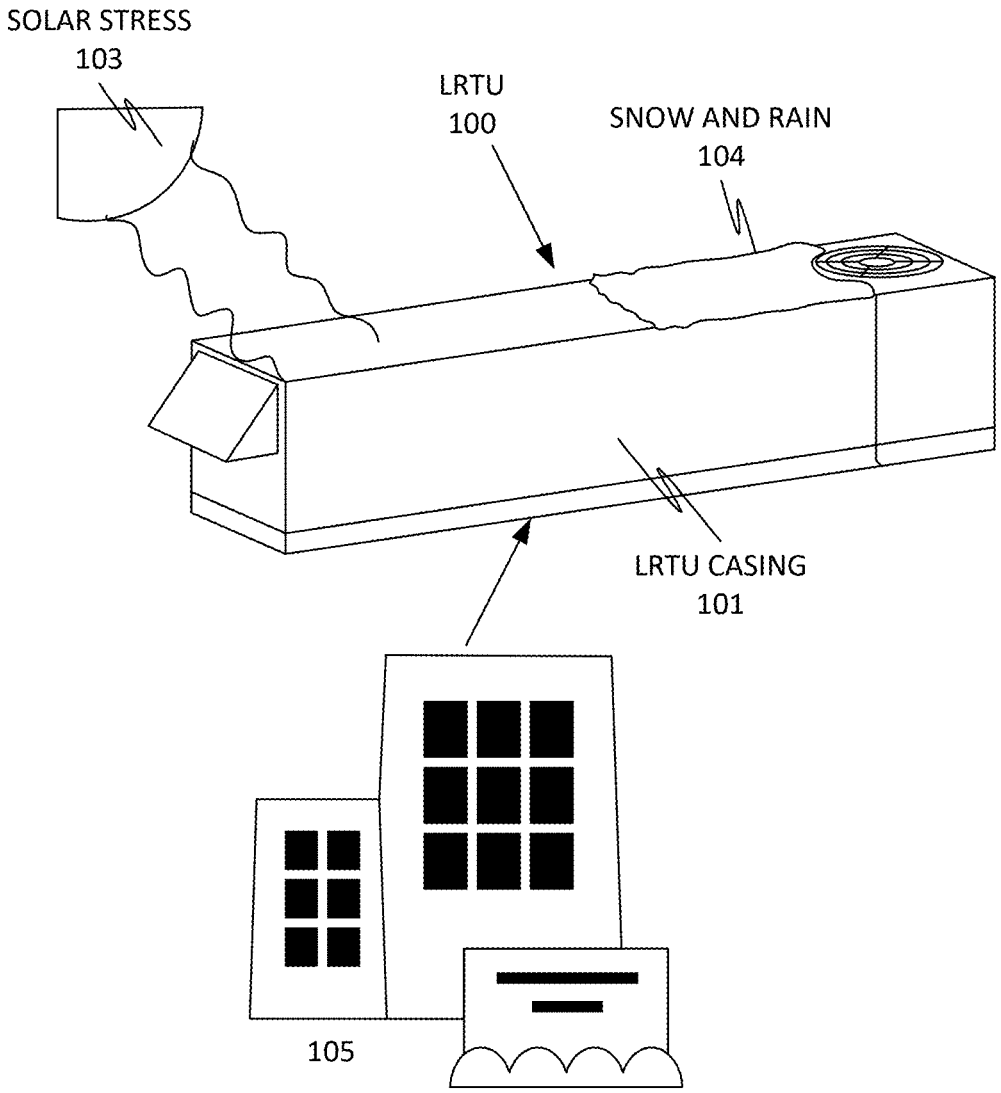
FIG. 1 illustrates an exemplary embodiment of an LRTU.

The present disclosure provides an improved HVAC RTU design and construction, featuring a Lightweight RTU (LRTU) predominantly constructed with lightweight synthetic materials such as, for example, Polypropylene Random Copolymer (PPR). The LRTU may be fortified with a weather-resistant surface coating suitable to resist external environmental elements the LRTU encounters in a geographic environment. A robust housing or casing of the LRTU safeguards the HVAC system's core components against weather, debris, and potential harm. The weather-resistant surface coating of the LRTU, which may include materials such as thin layer of galvanized steel or other metallic or impervious plastic coatings, provides a shield against the adverse physical impacts of various weather conditions.

The LRTU is preferably formed by multiple disparate portions that may be configured to a size and shape specific to deployment suitable for a particular building, or portion of a building. It is noted that in some embodiments, different portions may be manufactured using different modalities of manufacturing processes. For example, larger portions may be extruded PPR onto a thin coating of galvanized steel, and smaller portions of intricate shapes may be injection molded or 3D printed and coated with a metallic coating.

In some embodiments of the apparatus, a novel construct for Polypropylene Random Copolymer (PPR) Lightweight Roof Top Units (LRTUs) may be tailored for outdoor installations to conserve precious indoor space and address the environmental shortcomings of traditional HVAC materials. Recognizing that conventional construction materials for RTUs carry a substantial carbon footprint, the disclosure proposes a comparatively lightweight, eco-friendly alternative that significantly reduces the structural demands on buildings and the associated energy consumption during transport and installation.

The LRTU's primary structure is crafted from PPR due to its favorable attributes—being both lightweight and less taxing on the environment. However, to ensure longevity and resistance to the harshness of direct sunlight and weather conditions, the PPR requires additional protection. To this end, the device incorporates a sheeting of PPR with a thin metallic or non-metallic barrier (protective layer), such as, but not limited to, stainless steel, galvanized steel, or aluminum. This layer offers structural integrity while providing a shield against the elements, effectively decreasing the volume of heavier metallic materials traditionally used.

The embodiment may contemplate a metallic or non-metallic layer that may be applied solely to the exterior or may envelop both sides of the PPR, essentially encapsulating the plastic core. This metallic protection can be achieved through a bonding process of PPR to metallic sheets or by spraying a metallic coating onto the PPR sheet, which may be produced via extrusion or 3D printing techniques.

The LRTU significantly mitigates environmental impact not only due to the more sustainable manufacturing process of PPR compared to steel but also because the unit's comparatively lightweight nature demands less energy for transportation. A preferred cylindrical shape of an LRTU is suggested, which can be realized by rolling PPR/metal composite materials into an arcuate shape, sometimes referred to as a "tubular" shape. An arcuate shaped LRTU may include one or more planer (flat) portions, such as, for example, a base portion. This may involve constructing the LRTU from panels that are cut and assembled, or using portions of PPR protected with metallic coating alongside portions that are solely metallic, depending on the needs.

The LRTUs are relatively non-corrosive as compared to traditional RTU units and suitable for retrofitting applications that demand higher hygiene standards. The installation process is expedited, leading to reduced labor costs and time. With a higher R-value, these LRTUs provide better insulation, leading to energy savings. The flexible supply chain for PPR and metallic materials contributes to the LRTU's adaptability in production and distribution.

Monitoring the health of the LRTU may be facilitated by measurements across the various portions, where stresses may be assessed via changes in electrical resistance. Furthermore, the LRTU supports sustainability by allowing for the regrinding of plastic components and the recycling of steel, thereby contributing to a circular economy in HVAC system production.

In some embodiments, building upon the innovative components of the LRTU, further enhancements may be made to optimize its functionality and environmental compatibility. One such enhancement may involve the integration of an energy recovery ventilator (ERV) system within the LRTU. This system may capture the energy from exhaust air to precondition incoming fresh air, significantly improving energy efficiency, especially in extreme weather conditions. This ERV integration may be particularly beneficial in maintaining indoor air quality while reducing the energy load on the HVAC system. Additionally, considering the growing focus on sustainable energy sources, the LRTU may incorporate photovoltaic solar fabric, a flexible and lightweight material, over portions of its surface. This solar fabric may also serve as an additional power source besides acting as an extra protective layer, contributing more to the unit's overall energy efficiency, and reducing its reliance on traditional energy sources.

Other embodiments may enhance the LRTU's adaptability and maintenance ease through the incorporation of smart diagnostic sensors. These sensors may continuously monitor the unit's performance and health, providing real-time data analytics for predictive maintenance and early detection of potential issues. The use of such advanced diagnostics may extend the lifespan of the LRTU and optimize its performance.

Furthermore, in some embodiments, for the outer weather-resistant coating or layer, the use of nano-coatings may offer superior protection. Implementing such a coating may significantly enhance the unit's resilience and longevity. Nano-coatings, at the forefront of material technology, are composed of nanoparticles that, when applied to a surface, create an incredibly thin yet highly effective protective layer. These coatings are renowned for their exceptional durability and their resistance to a wide array of environmental stressors, including UV rays, moisture, and extreme temperature fluctuations. The application of nano-coatings on the LRTU's outer surface may impart several significant advantages. Firstly, the resistance to UV radiation is helpful to prevent degradation or weakness in the unit's material over time, due to prolonged sun exposure, which is a common issue on rooftops. This feature may maintain the structural integrity and appearance of the unit. Secondly, the hydrophobic nature of many nano-coatings makes the LRTU resistant to moisture, preventing issues such as corrosion, mold growth, and water damage, which are common in outdoor environments. This moisture resistance further extends the unit's operational lifespan and reduces maintenance needs.

Moreover, nano-coatings are adept at handling extreme temperature variations, protecting the LRTU from the thermal expansion and contraction that can occur in fluctuating climates. This adaptability is helpful to maintain the unit's structural soundness and functionality, regardless of seasonal temperature shifts. Another noteworthy aspect of nano-coatings is their self-cleaning properties. Due to their unique surface characteristics, dirt and debris are less likely to adhere to the coated surface, meaning the LRTU remains cleaner without requiring frequent manual cleaning, thus reducing maintenance efforts and costs.

Nano-coatings, characterized by their molecular-level precision and robust protective qualities, encompass a diverse range of materials, each tailored for specific applications. One prominent example is Titanium Dioxide (TiO2) nano-coatings, widely used for their photocatalytic properties and UV protection, making them ideal for outdoor applications like HVAC units. Another example is Silicon Dioxide (SiO2) or silica-based nano-coatings, renowned for their hydrophobic (water-repellent) qualities, which effectively protect surfaces from moisture and reduce dirt accumulation. Additionally, Zinc Oxide (ZnO) nano-coatings are noted for their antimicrobial properties and UV protection, often used in medical and outdoor equipment. Carbon nanotubes, though more specialized, offer exceptional strength and thermal conductivity, which can be advantageous in heat-intensive environments. Moreover, graphene, a single layer of carbon atoms arranged in a hexagonal lattice, is gaining attention for its remarkable strength, electrical conductivity, and thinness, making it a groundbreaking material in nano-coatings. Lastly, Polyurethane nano-coatings are utilized for their flexibility and durability, providing a resilient protective layer against physical abrasions and environmental wear and tear. Each of these nano-coating materials offers unique benefits, from UV protection and hydrophobicity to antimicrobial properties and structural strength, thus providing versatile solutions for enhancing the durability and functionality of various applications, including HVAC systems.

In some embodiments of the apparatus, the outer weather-resistant coating or layer of the LRTU may be constructed using PPR (Polypropylene Random Copolymer) that has been enhanced with nano-coatings. This approach involves imbuing the PPR with nano-scale materials to significantly bolster its protective qualities. In some other cases, PPR or other polymers can be used as part of a nanocomposite coating for the outer weather-resistant coating or layer of the LRTU. In such cases, nanoparticles or nanofillers (e.g., silica nanoparticles, clay nanoparticles) can be dispersed within a polymer matrix (including PPR) endowing it with superior mechanical strength and improved barrier properties, which are essential for withstanding environmental stressors. These nanocomposite coatings demonstrate enhanced performance characteristics over traditional polymer coatings, including increased durability, resistance to UV radiation, moisture, and thermal extremes. While PPR in its standard form is not a nano-coating material, its amalgamation with selected nanoparticles or nanofillers in a nanocomposite arrangement allows it to achieve advanced functionalities. This integration effectively elevates the weather-resistant capabilities of the LRTU, ensuring its longevity and reliability as an HVAC solution.

Some embodiments of the apparatus may include enhanced modular components for the LRTU, implementing a snap-fit or interlocking mechanism for joining different portions of the unit for simplifying the assembly process, making it more efficient and cost-effective, especially during installation or routine maintenance. The snap-fit mechanism may include edges of the LRTU's modular components with complementary shapes that can easily click or lock together without the need for additional fastening tools or hardware. Snap-fit mechanisms along modular component edges not only streamlines an LRTU assembly process but also significantly reduces an amount of time and labor involved in the installation. The interlocking parts may be precision-engineered to ensure a secure and robust connection, to facilitate maintaining structural integrity and performance efficiency of the HVAC system. This method of assembly is particularly advantageous in rooftop environments, where ease of installation is paramount due to the often challenging and less accessible nature of these spaces. Further, in some cases, these interlocking parts may also be joined together using basic fastening tools like nuts, bolts, or screws.

Furthermore, the snap-fit features inherently allow for easy disassembly, which is a major advantage during maintenance or repair operations. Service technicians can quickly disengage the interlocking components, perform maintenance or replacements, and reassemble the unit with minimal effort and time. This feature not only enhances the serviceability of the LRTU but also contributes to reduced maintenance costs over its lifespan.

Moreover, this modular and tool-less assembly approach can facilitate customizable configurations of the LRTU. Depending on the specific needs of a building's HVAC system, components can be added, removed, or rearranged with greater flexibility, adapting to varying architectural demands or changes in air conditioning requirements over time. This flexibility, combined with the ease of assembly, positions the LRTU as a highly adaptable and user-friendly option in the realm of HVAC solutions.

In the following sections, detailed descriptions of examples, apparatuses and methods will be given. The description of both preferred and alternative examples, though thorough, are exemplary only. It is understood by those skilled in the art that various modifications and alterations may be apparent and within the scope of the present disclosure. Unless otherwise indicated by the language of the claims, the examples do not limit the broadness of the aspects of the underlying apparatus as defined by the claims.

Referring now to FIG. 1, in an exemplary embodiment, the LRTU 100 is situated in its operational environment atop a building structure 105. The LRTU 100 is encased within a protective housing, labeled as LRTU Casing 101, which is mainly constructed from PPR with a protective outer layer that may consist of either a metallic or non-metallic substance as discussed in some embodiments of the apparatus. The LRTU Casing 101 may shield the internal components of the LRTU 100 from various environmental elements.

The Solar Stress 103, depicted as a wavy arrow pointing towards the LRTU 100, signifies the impact of solar radiation on the LRTU 100. This aspect of the LRTU 100 enables the LRTU 100 to withstand prolonged exposure to sunlight, which can contribute to thermal stress and the potential degradation of material over time. Additionally, the LRTU 100 is also shown in the context of Snow and Rain 104 to illustrate the LRTU's 100 exposure to various forms of precipitation, necessitating a robust and weather-resistant design to ensure consistent operation through diverse, and potentially harsh, weather conditions.

FIG. 1 illustrates the LRTU's resilience and the effectiveness in protecting against environmental stressors, aligning with the device's objective to provide a durable, efficient, and environmentally conscious HVAC solution.

In accordance with various embodiments of the present apparatus, the LRTU Casing 101 may innovatively offer enhanced protection and durability for HVAC systems. At the core of this apparatus is the use of Polypropylene Random Copolymer (PPR) as the primary material for the construction of the LRTU Casing 101. PPR is selected for its notable characteristics, including its lightweight nature, structural strength, and resistance to environmental factors such as chemical corrosion and temperature variations. These properties make PPR an ideal choice for rooftop applications where exposure to diverse weather conditions is a constant challenge.

To further reinforce the LRTU 100 and safeguard its internal components, the PPR layer may be coated with a protective layer (metallic or non-metallic layer), such as galvanized steel. This metallic coating or layer serves multiple critical functions. Firstly, it acts as a robust barrier against environmental elements like rain 104, snow, and UV radiation, preventing direct contact with the PPR layer and thus averting potential material degradation over time. The galvanized steel coating is particularly effective in shielding the unit 100 from moisture-induced damage and corrosion, a common issue in metallic components exposed to the outdoors.

Secondly, the protective layer enhances the overall structural integrity of the LRTU 100. Galvanized steel, known for its strength and durability, provides additional rigidity to the unit 100, ensuring it remains stable and secure in various climatic conditions, including high winds or heavy snow loads. This added strength facilitates maintenance of the shape and functionality of the LRTU 100 over its lifespan.

Thirdly, the combination of PPR with a galvanized steel coating contributes to the thermal efficiency of the LRTU 100. The metallic layer reflects a significant portion of solar radiation, thereby reducing the heat absorbed by the unit 100. This reflection helps in maintaining a more stable internal temperature, which is beneficial for the optimal performance of the HVAC system housed within the LRTU 100.

In addition, the smooth surface of the galvanized steel coating facilitates easier maintenance and cleaning of the LRTU 100. This ease of maintenance facilitates the ability to maintain the LRTU 100 in optimal condition, further extending its operational life and reliability. Overall, the use of PPR as the main structural layer, combined with an outer protective layer or coating, provides a superior solution for rooftop HVAC units. This combination facilitates protection of the components within the LRTU 100 from environmental elements, leading to a more durable, efficient, and reliable HVAC system.

Figure 1A:
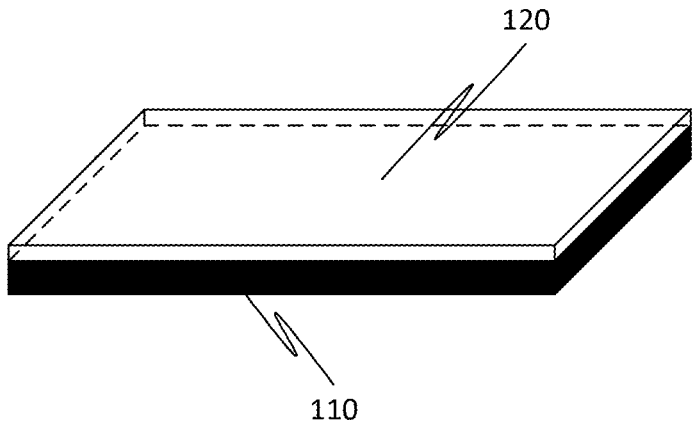
FIG. 1A and FIG. 1B illustrate exemplary cross-sectional views of a multi-layered LRTU material.
Figure 1B:
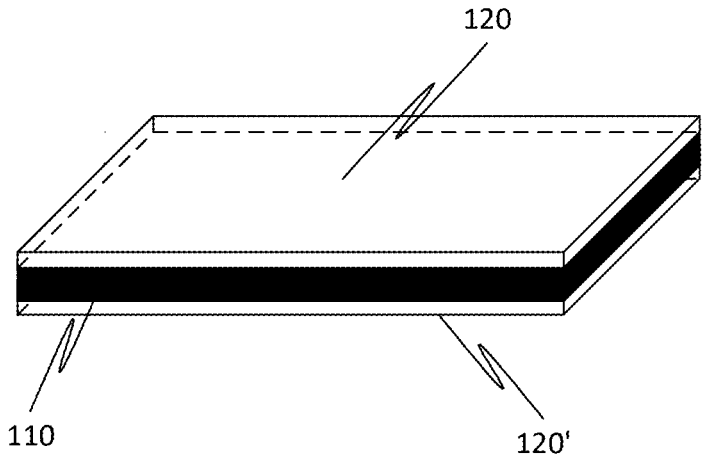

FIG. 1A and FIG. 1B provide cross-sectional views of the material layers in a Lightweight Roof Top Unit (LRTU) 100 according to the embodiments discussed in the disclosure. FIG. 1A depicts a fundamental two-layered configuration. PPR Layer 110 constitutes the primary structure and may be fabricated from Polypropylene Random Copolymer (PPR), or other synthetic material chosen for its lightweight, strong, and environmentally friendly properties. The PPR Layer 110 forms the structural core of the LRTU 100, providing durability and performance.

Overlaying the PPR Layer 110 base, Layer 120 serves as a protective barrier applied to the first side of the PPR Layer 110 base. Layer 120 may face the environment and provide a shield against various weather conditions, UV radiation, and other external factors that may degrade the PPR Layer 110 over time. The Layer 120 may be composed of a metallic substance like aluminum or galvanized steel, which provides added resilience and structural support. Alternatively, Layer 120 may consist of non-metallic materials, including UV-resistant polymers, high-grade plastics, or nanocomposite coatings, which may be selected to bestow specialized attributes ranging from increased durability and reflective capacity to self-cleaning features attributed to its nano-scale structure.

In FIG. 1B, an enhanced layered composition for the LRTU 100 is illustrated, featuring a second protective Layer 120' on the second or opposite side of the PPR Layer 110, thus forming a 'sandwich' configuration. The second protective Layer 120' may be similar to or different from the first protective Layer 120, allowing for a customizable approach depending on the specific requirements of the LRTU's 100 application. For example, if Layer 120 is a metallic layer or coating for durability, Layer 120' may be a nanocomposite coating providing thermal insulation or acoustic dampening, providing a multifunctional protective system. In some embodiments of the apparatus, a thermal insulation layer, may be added between the PPR Layer 110 and the protective Layers 120 and 120'. The combination of Layers 120 and 120' on either side of the PPR Layer 110 may offer a balance between protection and functional enhancement. Moreover, the LRTU 100 may integrate additional layers beyond the depicted dual coating, leading to a multilayered edifice capable of sophisticated functional enhancements tailored to diverse climatic and environmental challenges.

In some embodiments of the apparatus, the LRTU 100 manufacturing process may involve applying multiple layers on one or both sides of the Polypropylene Random Copolymer (PPR) core layer 110. On either side, the layers may serve various functions. Some layers may be dedicated to insulation, enhancing the thermal efficiency of the LRTU 100. Others may be specialized for noise or sound-dampening, significantly reducing the operational sound of the HVAC system, which is particularly beneficial in noise-sensitive environments. Additionally, certain layers may be focused on vibration isolation, mitigating the transmission of vibrations from the unit to the building structure.

In some embodiments of the apparatus, a method for creating or manufacturing an LRTU 100 with a multilayered structure may leverage a combination of advanced materials and manufacturing techniques to produce an LRTU 100 optimized for energy efficiency, durability, and environmental sustainability.

The process begins with the preparation of materials, primarily sourcing high-quality PPR for the base layer 110 due to its advantageous properties of lightness, structural integrity, and eco-friendliness. Alongside PPR 110, materials for protective layers are selected, which may include metals such as aluminum or galvanized steel for robustness or non-metallic options like UV-resistant polymers and nanocomposite coatings that offer specific functional benefits.

The PPR 110 is then formed into sheets or molded to fit the dimensional specifications of the LRTU 100. This is achieved through techniques like extrusion or molding, followed by a cooling and curing process to solidify the PPR 110 into its desired shape and size with the requisite strength.

Upon forming the PPR layer 110, protective layers 120, 120' are applied. Metallic options may involve a lamination process, where metal sheets are bonded to the PPR core 110, utilizing heat and adhesives to create a firm bond. Non-metallic coatings may be applied through methods such as spraying or painting, with each layer undergoing a specific curing process to ensure it sets properly and provides the intended protective qualities.

Additional coatings may be added to enhance functionality, such as thermal insulation or sound dampening. These coatings may be applied in stages, with each layer requiring its own set of application and curing conditions to provide optimal performance and adherence.

After preparing the multilayered structure, the assembly of the LRTU 100 commences. Components like fans, coils, and dampers are integrated, ensuring mechanical and electrical systems are in place for the unit 100 to function as a cohesive HVAC system. The LRTU 100 may incorporate modularity to facilitate maintenance and future component upgrades.

A rigorous quality assurance phase may follow, where the assembled LRTU 100 is tested for performance against environmental conditions, efficiency, and longevity. These tests may ensure that the LRTU 100 meets the stringent requirements for thermal efficiency, acoustic performance, and durability.

An LRTU 100 may be subjected to quality assurance tests and/or inspection to identify and rectify any defects. The LRTU 100 may then be packaged to protect the integrity of the multilayered structure during transportation and handling. The LRTU 100 is then dispatched, ready for installation at its destination or storage. The LRTU 100 may be of reconfigurable nature, allowing for future layer replacements or upgrades, the use of smart materials that may respond to environmental stimuli, and the commitment to sustainability through the choice of materials and manufacturing processes. The resulting LRTU 100 stands as a testament to innovative HVAC design, comprising functional needs with environmental consciousness.

In an embodiment of the apparatus, the construction of an LRTU 100 may capitalize on the versatile nature of polypropylene (PP), a thermoplastic polymer that is extensively used across various industries, including automotive and construction, due to its adaptability and strength. Some embodiments of the apparatus may utilize polypropylene as the primary construction material for the LRTU 100, benefiting from its range of applications that underscore its utility in both durable and flexible environments.

The physical properties of polypropylene make it exceptionally suitable for rooftop units. Its resistance to a broad spectrum of chemical solvents, as well as acids and bases, facilitates the ability of the LRTU 100 to withstand harsh environmental conditions without material degradation. Moreover, the toughness of PP, coupled with its flexibility and high resistance to cracking, allows the LRTU 100 to endure mechanical stresses such as wind load, thermal expansion, and vibrations without failure.

At the molecular level, polypropylene's semi-crystalline structure provides a balance of strength and processability. Manufactured by the polymerization of propylene monomer with catalysts, PP can be tailored during the LRTU's 100 construction to achieve the desired mechanical and thermal properties. The semi-crystalline nature of PP also contributes to the LRTU's 100 thermal insulation characteristics, an essential factor in HVAC efficiency.

Processing techniques such as injection molding, blow molding, and extrusion may be utilized to shape the polypropylene into the required components of the LRTU 100. These processes may be selected based on the size and shape and performance requirements of the LRTU 100, allowing for the creation of intricate shapes and the incorporation of features that optimize airflow and system integration.

Addressing environmental concerns, the LRTU 100 may include environment-sustainable aspects. While polypropylene is traditionally known for its persistence in the environment and resistance to biodegradation, some embodiments of the apparatus may emphasize the recyclability of a material used to construct an LRTU 100. The LRTU 100 may be formed of modular portions of a size and shapes conducive for facilitating easy disassembly at the end of the life cycle of the LRTU 100, allowing each polypropylene component to be reclaimed and processed at recycling facilities. Such an approach not only minimizes the environmental impact of the LRTU 100 but also aligns with the principles of circular economy, where the goal is to keep materials in use for as long as possible and to recover and regenerate products at the end of their service life.

In some embodiments, the LRTU 100 may be constructed entirely from a specific type of Polypropylene Random Copolymer (PPR) that is optimized for high thermal resistance and durability without the need for additional layers of insulation. The specialized PPR is engineered to have enhanced insulating properties through its molecular composition, allowing it to effectively maintain internal temperature stability and energy efficiency. By utilizing this advanced form of PPR, the LRTU 100 can achieve desired thermal and structural performance while simplifying the manufacturing process and reducing material costs, making it both economically and environmentally beneficial.

In other embodiments, the LRTU 100 may utilize PPR as the core structural layer, supplemented by additional layers of insulation applied to one or both sides of the PPR core layer. Such a configuration leverages the inherent durability and environmental resistance of PPR while enhancing its thermal insulation capabilities through the addition of specialized insulating materials. These added layers may improve the unit's energy efficiency by minimizing heat transfer, thereby reducing the heating and cooling demands on the system.

Figure 2:
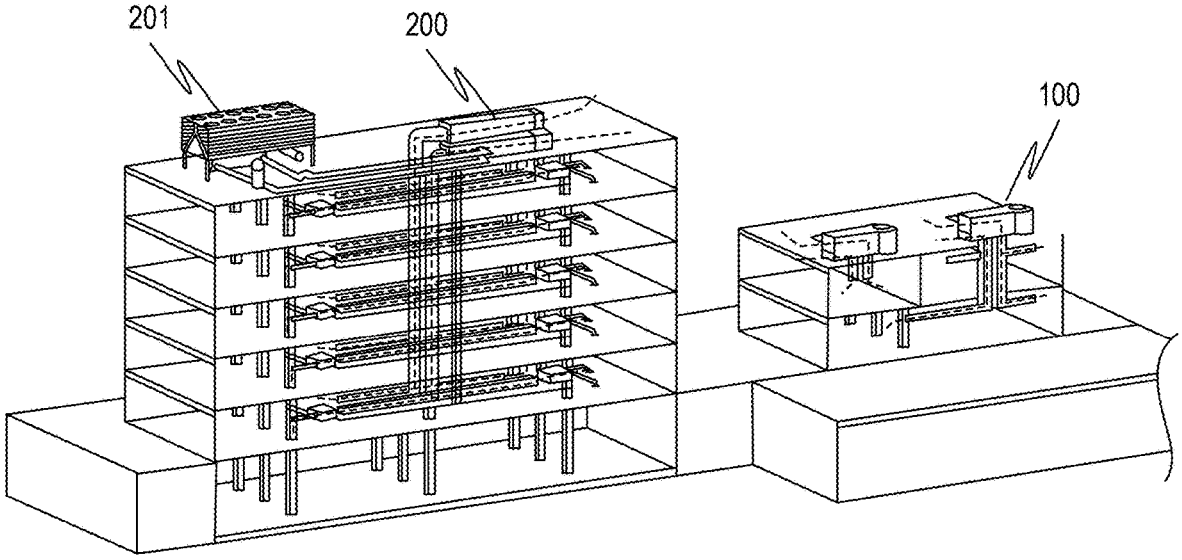
FIG. 2 illustrates a schematic representation of LRTU integration with the building HVAC system.

Referring now to FIG. 2, an exemplary view of a building HVAC system showcasing the interrelation between various components, including the LRTU 100. The LRTU 100 is depicted alongside other critical elements of the HVAC system, namely the Air Handler Unit (AHU) 200 and the Air-Cooled Chiller 201. These components are typically found within the mechanical services area of a building's rooftop or a designated utility space. The Air Handler Unit 200 is responsible for the circulation and regulation of air throughout the building's interior spaces. It is typically connected to ductwork that distributes conditioned air through various zones and returns it to the AHU 200. The Air-Cooled Chiller 201 functions to remove heat from the indoor air through the refrigeration cycle, contributing to the cooling requirements of the HVAC system.

The LRTU 100, as part of this assembly, is strategically positioned to facilitate its role in the overall climate control process. Its construction from PPR with a protective outer layer is essential for withstanding the external rooftop environment, where it works in tandem with the AHU 200 and Air-Cooled Chiller 201 to provide efficient heating, cooling, and ventilation. The integration of these components into a cohesive system demonstrates the importance of each unit's design (size and shape) and placement in achieving optimal HVAC performance. FIG. 2 illustrates the LRTU's 100 compatibility and functionality within a larger HVAC network, highlighting its significance in a comprehensive climate control solution for modern buildings.

Figure 3:
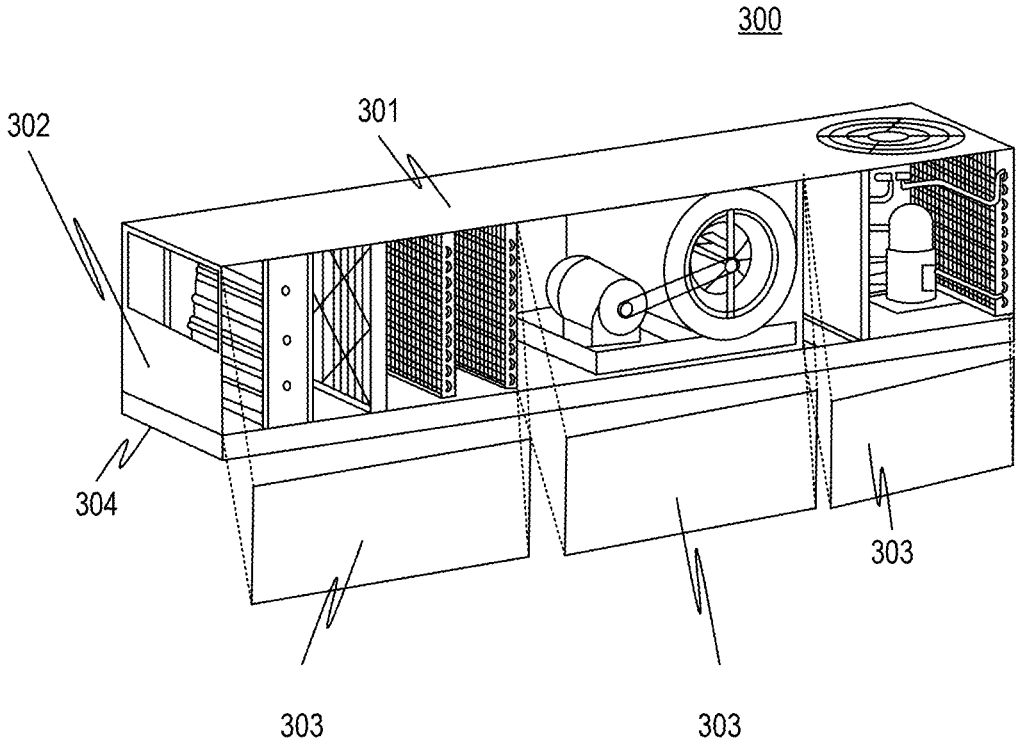
FIG. 3 illustrates an exemplary embodiment of LRTU showcasing modular panels for easy assembly and maintenance.

Referring now to FIG. 3, an exemplary representation of the LRTU 300, with a focus on modular portions and component architecture is illustrated. The LRTU 300 is shown featuring multiple modular components, referred to as LRTU Casing Side Panels 303. These panels are part of the LRTU's 300 protective casing, with the LRTU Casing Top 301 and LRTU Casing End Panel 302, delineating the complete enclosure of the LRTU 300.

The Modular Components 301-303 are formed in sizes and shapes that facilitate easy assembly and disassembly, which is essential for efficient transportation, installation, and repair. For example, in some embodiments, modularity allows for the LRTU 300 to be disassembled into modular components, such as, by ways of non-limiting example, one or more of: a LRTU casing top 301, a LRTU casing end panel 302, a LRTU side panel, and a LRTU base panel 304. Manageable sections, such as LRTU panels 301-304, simplify transport of the LRTU 300 to an installation site, particularly when space constraints or access limitations are present. Use of modular components, such as LRTU panels 301-304, significantly reduces logistical challenges and costs associated with moving large, unwieldy equipment.

Once on-site, the modular nature of the LRTU 300 simplifies the installation process as well. Technicians can quickly assemble the LRTU 300 modular components (such as, for example, LRTU panels 301-303 and base unit 304), which is especially advantageous in rooftop applications where time and space are at a premium. The ability to add or remove modular components also provides flexibility in system configuration and the potential for future expansion or reconfiguration as building needs evolve.

Furthermore, modular components enhance the serviceability of the LRTU 300. Maintenance personnel can easily access internal components by removing specific panels 301-303, facilitating timely repairs and routine service checks without the need for complete system disassembly. Removing specific panels 301-303 not only minimizes downtime but also extends the life of the LRTU 300 by ensuring that all components are readily accessible for maintenance. The Modular Panels 301-303 of the LRTU 300 allow for a more streamlined and cost-effective lifecycle of the LRTU 300, from transportation and installation to operation and maintenance, reflecting the adaptability and user-friendly design.

In some embodiments of the apparatus, the LRTU 300 is distinguished by its modular components, featuring an array of interlocking panels 301-303, including the LRTU Casing Top 301, the LRTU Casing End Panel 302, multiple LRTU Casing Side Panels 303, and a base unit 304. Each panel (e.g., 301-303) may include an individual module that can be swiftly assembled or disassembled, providing unparalleled adaptability and ease of maintenance.

Modular components may include specialized sealing mechanisms between panels that may enhance the unit's weather resistance, ensuring that each join is both secure and impervious to environmental elements. This sealing technique may not only protect the interior components of the LRTU 300 but also simplify the process of replacing or repairing individual Module Panels 301-303 without disturbing the integrity of the entire LRTU 300.

Another innovative aspect of the Modular Panels 301-303 of the LRTU 300 may be their construction with integrated insulation materials that enhance the energy efficiency of the LRTU 300. These materials may be embedded within the panels themselves, thereby maintaining comparatively lightweight characteristic of the LRTU 300, while optimizing thermal efficiency.

The modular panels may include acoustic dampening properties to reduce operational noise, a feature that is increasingly important in urban or residential areas. Furthermore, the exterior surfaces of the panels may be treated with a reflective coating to minimize solar heat gain, further contributing to the overall energy efficiency of the LRTU 300.

For added functionality, certain Modular Panels 301-303 of the LRTU 300 may be equipped with quick-release mechanisms that allow for rapid access to the interior of the LRTU 300 for maintenance or emergency repairs. These quick-release mechanisms may be operated without specialized tools, emphasizing ease of use and efficiency.

In some embodiments, the LRTU 300 may incorporate external casing components, namely the LRTU Casing Top 301, the LRTU Casing End Panel 302, and the LRTU Casing Side Panels 303, utilizing Polypropylene Random Copolymer (PPR) as the core material, complemented by a combination of protective layers.

Casing components may include a core including PPR (or similar synthetic materials), chosen for their superior chemical resistance, low moisture absorption, and resilience against environmental stress cracking and UV degradation. PPR's robustness makes it ideally suited for external applications where exposure to diverse weather conditions is a given. The inherent flexibility of PPR also allows for design versatility, accommodating various architectural demands without compromising on structural integrity.

To enhance these properties, the PPR core may be layered with additional protective materials on one or both sides, depending on specific environmental needs and operational demands. These protective layers are selected for their ability to fortify the structure against physical impacts and environmental elements while enhancing the unit's overall performance. Options for these layers include metallic coatings such as aluminum or galvanized steel, which provide added rigidity and contribute to the mechanical strength, making the units capable of withstanding harsh conditions including heavy winds and precipitation. In some embodiments, fibers, such as fiberglass fibers, may be included in the core to reinforce the PPR.

Alternatively, non-metallic coatings may also be applied, featuring advanced polymers and nanocomposite materials providing increased UV protection, improved thermal insulation, and reduced conductivity. These coatings may particularly be beneficial in hot climates where they mitigate heat absorption, thus reducing the cooling load on the HVAC system and enhancing energy efficiency. The non-metallic coatings may also include functional additives such as antimicrobial agents or self-cleaning technologies that reduce maintenance needs and prolong the lifespan of the panels.

In some configurations, a hybrid approach may be employed, where both metallic and non-metallic layers are used in conjunction. This combination may leverage the benefits of both types of materials, providing a balanced solution that addresses durability, insulation, and environmental resistance. For example, the exterior may feature a metallic layer to benefit from its strength and durability, while the interior side may be coated with a reflective polymer to minimize heat gain and improve energy efficiency.

The construction of these components is modular, facilitating not only ease of manufacture and installation but also maintenance and potential future upgrades. Each Modular Panel 301-303 may include a size and shape that easily fits into an LRTU 300 framework, allowing for quick replacement or modification as required by maintenance schedules or architectural updates.

Figure 3A:
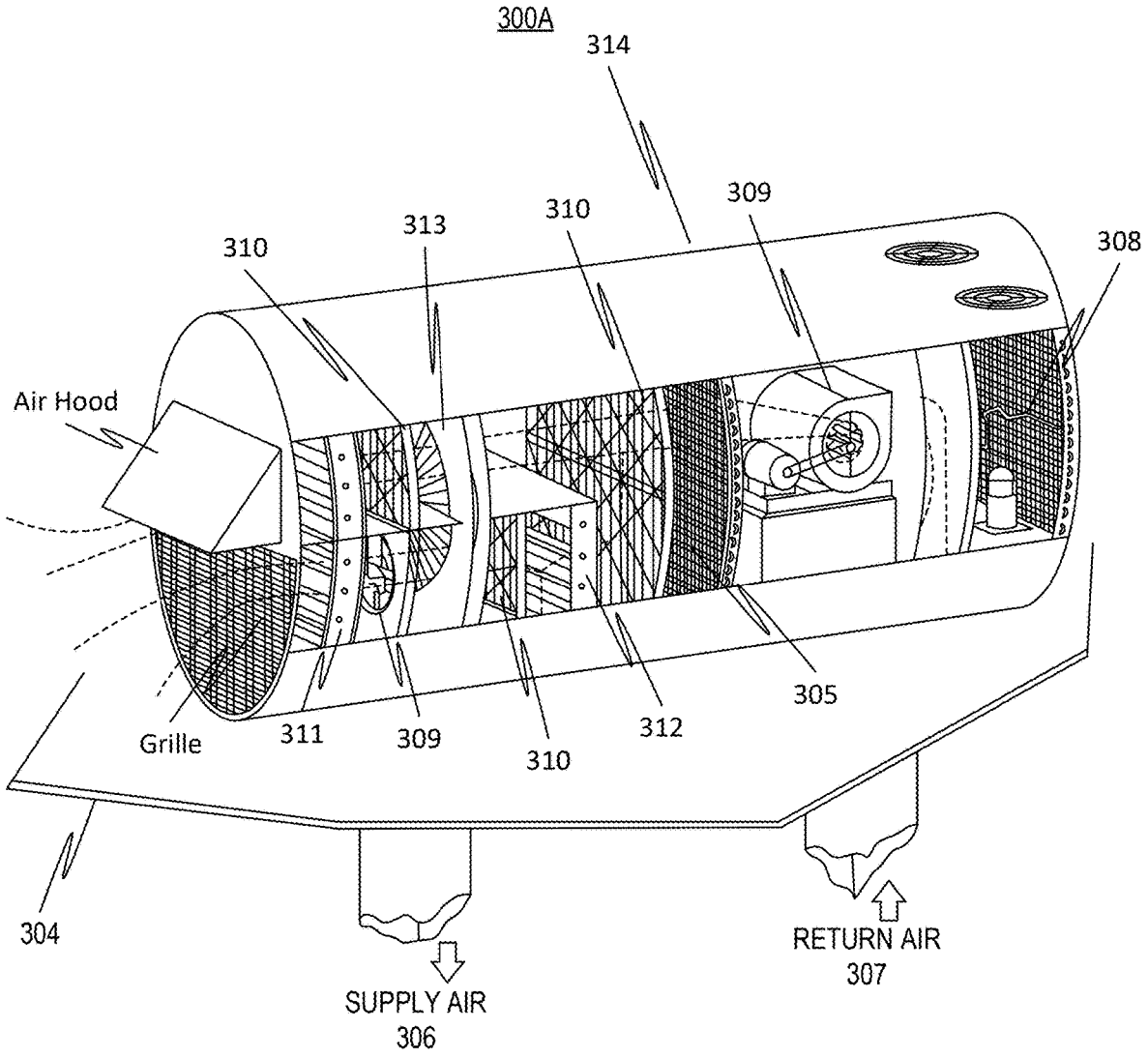
FIG. 3A illustrates an exemplary LRTU having a tubular shape with no flat surfaces in accordance with some embodiments of the apparatus.

Referring now to FIG. 3A, an exemplary view of an LRTU 300A is illustrated in accordance with the disclosure. The LRTU 300A comprises a distinctive tubular shape that differentiates it from traditional rectangular units. The LRTU 300A with a tubular shape may offer several advantages, including enhanced aerodynamics, increased structural integrity, and the potential for improved airflow management within the unit.

The outer shell of the LRTU 300A may be crafted from a durable and hygienic material, specifically Polypropylene Random Copolymer (PPR). The choice of PPR not only contributes to the structural robustness of the unit but may also allow for the construction of the LRTU 300A without the need for additional layers of insulation. This is due to the inherent thermal insulating properties of PPR, which may help in maintaining the desired temperature within the unit while also contributing to energy efficiency.

The LRTU 300A placed on the Roof 304 of a building comprises a smooth, tubular exterior with no flat surfaces. The tubular shape may be particularly beneficial in maintaining high hygiene standards, as it eliminates corners and crevices where dirt and contaminants can accumulate. The smooth surfaces facilitate easy cleaning and maintenance, ensuring that the LRTU 300A can be kept in a pristine condition, which is helpful for environments where cleanliness is paramount, such as hospitals, laboratories, and food processing facilities.

Inside the LRTU 300A, various critical HVAC components are housed, each playing a helpful role in the operation of the LRTU 300A. HVAC components housed within a PPR (or other synthetic material) Housing 314 may include one or more of: Advanced Heating and Cooling Coils 305, Evaporator Coils 308, Fans 309, Filters 310, Exhaust Dampers 311, Mixing Damper 312, and Heat Wheel 313. Heating and Cooling Coils 305 are responsible for temperature regulation within the LRTU 300A. They efficiently transfer heat to or from the air that passes through them, ensuring that the air supplied to the building is at the desired temperature.

Evaporator coils 308 are typically an important component of the HVAC system within the LRTU 300A. Advanced Heating and Cooling Coils 305 function by absorbing heat from the air inside the building, causing the refrigerant within the Advanced Heating and Cooling Coils 305 to evaporate and effectively cooling the air. The cooled air is then circulated throughout the building, contributing to a comfortable indoor environment. The efficiency of the Advanced Heating and Cooling Coils 305 affects performance of the HVAC system, as the Advanced Heating and Cooling Coils 305 directly influence the LTRU's 300A ability to maintain desired temperatures while minimizing energy consumption. Advanced materials and shape enhancements in the Evaporator Coils 308 can facilitate favorable thermal transfer and durability, making the Advanced Heating and Cooling Coils 305 integral to the effective operation of the LRTU 300A.

Strategically placed Fans 309, including, for example, centrifugal fans, facilitate favorable air circulation within the LRTU 300A. LRTU Fans 309 may be equipped with electronically commutated (EC) motors that provide variable speed control, enhancing energy efficiency and reducing operational noise. Filters 310, such as, for example high-efficiency particulate air (HEPA) filters and other filtration units may be incorporated to purify incoming air. These Filters 310 may trap fine particulates, allergens, and other contaminants, facilitating high indoor air quality. Precision dampers, such as, for example, a Mixing Damper 312 and an Exhaust Damper 311 may regulate airflow within the LRTU 300A. They can adjust to allow for the recirculation of indoor air or the intake of fresh outdoor air, depending on the environmental conditions and indoor air quality requirements.

The construction of the LRTU 300A may also be modular, allowing for easy assembly and maintenance. The modular components can be quickly replaced or upgraded as needed, ensuring that the unit remains efficient and up to date with latest HVAC technologies.

The ductwork for the LRTU 300A can be seamlessly integrated into the building's HVAC system. The tubular shape of the unit allows for flexible duct connections that can be configured to suit various building layouts. The LRTU 300A comprises Supply Air Outlets 306 and Return Air Inlets 307, which facilitate efficient air distribution throughout the building. The supply air outlets deliver conditioned air to the occupied spaces, ensuring a comfortable indoor environment, while the return air inlets draw air back into the unit for reconditioning or expulsion to the environment.

Additionally, tubular shell components assembled to form an LRTU 300A may enhance aerodynamic flow of air through the LRTU 300A, reducing resistance and improving overall efficiency. By reducing flat surfaces of the LRTU 300A components, pressure drops, and turbulence may be reduced, allowing fans to operate more effectively and consume less energy.

Figure 4:
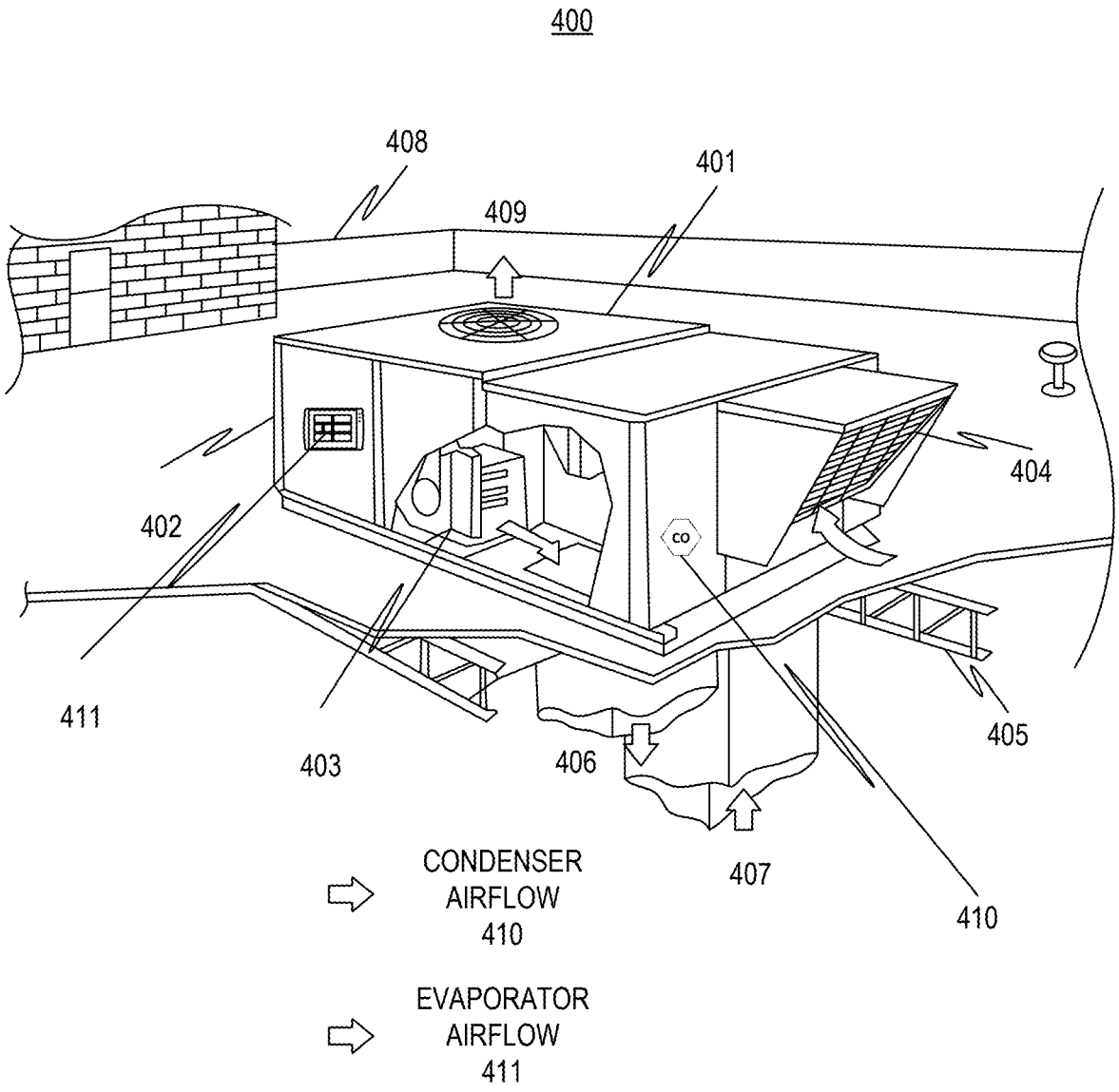
FIG. 4 illustrates an exemplary overview of an LRTU installed on a building roof.

Referring now to FIG. 4, an exemplary view of the LRTU 400 as part of an HVAC system, incorporating the principles and innovative aspects discussed in the present disclosure. The LRTU 400 may be designed with a focus on modularity, energy efficiency, and environmental protection, showcasing several distinct features and components. An LRTU 400 may include a Casing Top 401, a modular panel constructed from Polypropylene Random Copolymer (PPR) that may be enhanced with a protective layer or coatings for durability. This Casing Top 401 may serve as the primary shield against direct environmental exposure, such as solar radiation and precipitation, and may be potentially outfitted with nano coatings to mitigate wear and UV damage.

A Casing End Panel 402 works in conjunction with the Casing Top 401 to encapsulate the LRTU 400, providing a barrier that safeguards the internal components of the HVAC system. The Panels 401-402 may be formed in a size and shape facilitating easy removal, enabling access for maintenance and repair, which is part of the modular construct philosophy of the LRTU 400.

A Cooling Component 403 and other equipment may support climate control capability of the LRTU 400. The Cooling Component 403 may utilize advanced, eco-friendly refrigerants and be engineered for maximum heat exchange efficiency. The Cooling Component 403 may integrate variable speed fans and compressors to adapt its performance based on real-time demand, significantly reducing energy consumption.

An Economizer Hood 404 may be included to take advantage of cool external air when available, reducing the need for mechanical cooling and thereby enhancing the overall energy efficiency of the LRTU 400. This Economizer Hood 404 may be equipped with sensors to automatically adjust the air intake based on the outside temperature and air quality.

A Reduced Support 405 provides a lightweight yet sturdy framework that underpins the LRTU 400. It is optimized to minimize the load on the building structure while maintaining the stability and integrity of the LRTU 400, even under adverse weather conditions.

The Supply Air 406 and Return Air 407 channels the air circulation through the LRTU 400. The Supply Air 406 pathway directs conditioned air into the building, while the Return Air 407 channel cycles the indoor air back to the LRTU 400 for air reconditioning. The Supply Air 406 pathway provides airflow efficiency and may be lined with sound-dampening materials to minimize operational noise. A Roof Safety Wall 408, although not a part of the LRTU 400 itself, is an essential aspect of the installation environment. The layout of the LRTU 400 may integrate these components into a cohesive unit that prioritizes energy efficiency, ease of maintenance, and robustness against environmental stressors.

Supply Air 406 may provide airflow into an area serviced by the LRTU 400. Airflow through the LRTU 400 and may include Condenser Airflow 410 through a condenser, and Evaporator Airflow 410 through an evaporator. Return Air 407 may include air received from an area serviced by the LRTU 400. Exhaust Air 409 may include air exiting the LRTU 400.

In some embodiments of the apparatus, the LRTU 400 may be equipped with one or more environmental sensors 410 that provide data that is referenced to dynamically adjust the LRTU's operations based on real-time atmospheric conditions. Sensors 410 may quantify an environmental condition as a digital value and/or analogue value which may be transmitted to a control unit that includes a processor and memory and a transceiver for communicating to equipment and or a predictive analysis process. Sensors 410 may be strategically placed to detect a variety of environmental factors, including temperature, humidity, solar radiation, wind speed, and air quality. The Sensors 410 may include, by way of non-limiting example, one or more of: temperature sensors, solar radiation sensors, wind speed sensors, air quality sensors, Temperature sensors may provide data on external and internal temperatures, allowing the LRTU 400 to adjust LTRU 400 heating or cooling output and/or maintain a desired indoor climate efficiently. Humidity sensors monitor moisture levels in the air and may be located within the LRTU 400 and used to control humidity control equipment, which may not only influence thermal comfort but also impact the LRTU's cooling efficiency due to the effects humidity may have on latent heat.

Solar radiation sensors may measure and/or quantify the intensity of sunlight impacting the unit. Quantification may include generating a digital and/or analogue value, which may be used to adjust a cooling load and to control the operation of integrated solar panels, if present, to maximize solar panel energy generation while minimizing a heat gain from solar exposure.

Wind speed Sensors 410 may inform the LRTU 400 when to bolster system protections against potential wind damage, and when it is advantageous to leverage natural ventilation as part of the economizer function as discussed above. Air quality Sensors 410 may detect pollutants and particulates, prompting the advanced filtration system of the HVAC to adjust its operation to ensure a healthy indoor environment.

The Controller 411 of the LRTU 400, which interfaces with these Sensors 410, may utilize the data to intelligently adapt various components of the LRTU 400. For example, the control system can modulate fan speeds, open or close dampers, and regulate the economizer to improve air quality and energy efficiency. It may also initiate protective measures during adverse conditions, such as retracting or shielding components (which may be associated with the LRTU 400) that may be damaged by severe weather.

The LRTU 400 may also be integrated with a building management system (BMS), allowing it to operate in concert with other building systems and to respond to both occupant requirements and external environmental conditions. This level of integration and responsiveness not only enhances occupant comfort and safety but also promotes sustainable operation by reducing energy consumption and extending the service life of the HVAC system.

Figure 5:
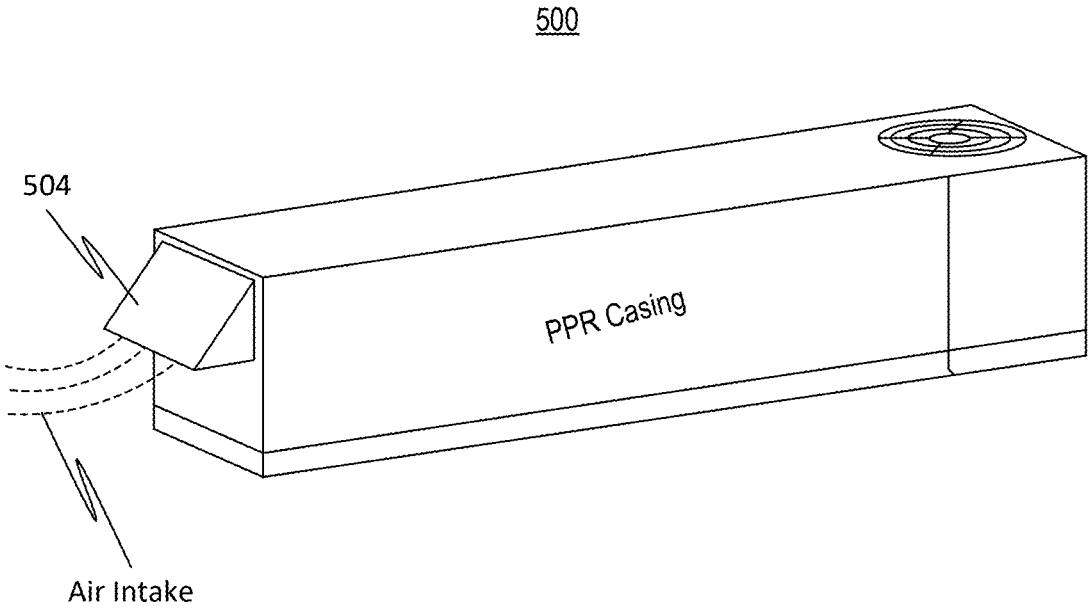
FIG. 5 illustrates an exemplary air hood and air intake system of an LRTU.

Referring now to FIG. 5, an exemplary view illustrates a component of the LRTU 500, specifically focusing on the air management subsystem, which includes an Air Hood 504 similar to the Economizer Hood 404 as discussed above in FIG. 4. This Air Hood 504 is a helpful part of the design of the LRTU 500 as it facilitates Air Intake 501, an entry point for the utilization of outside air within the HVAC system.

The function of the Air Hood 504 is to introduce ambient air into the LRTU 500, leveraging cooler external temperatures to reduce the load on the cooling system, thereby enhancing energy efficiency. This is particularly advantageous during periods when the outside air is sufficiently cool to assist in meeting the cooling requirements of the building without the need for the LRTU 500 to engage its full refrigerative cooling capabilities.

In keeping with the innovative aspects of the device, the Air Hood 504 may be equipped with a series of environmental sensors. These sensors can detect not only temperature but also humidity levels, air quality, and the presence of contaminants. This real-time environmental data allows the LRTU 500 to intelligently determine whether to utilize the economizer mode (of the Economizer Hood 404 or Air Hood 504), wherein the LRTU 500 increases the use of outdoor air to conserve energy.

Furthermore, the modular nature of the Air Hood 504 suggests that it may be designed for easy removal and attachment, facilitating maintenance and potential upgrades. The Air Hood 504 may also include adjustable louvers or dampers, which can be automatically or manually adjusted to control the volume and direction of the incoming air, ensuring optimal performance under varying environmental conditions and optimize air distribution throughout a serviced area within the building.

In some embodiments of the apparatus, the Economizer Hood 404 or the Air Hood 504 may include an aerodynamic shape to maximize air intake efficiency while reducing drag, thus minimizing the load on the internal fans of the LRTU 500, conserving energy.

The Economizer Hood 404 or Air Hood 504 may be constructed, for example, from a durable, weather-resistant material compatible with, or similar to, or the same as, the rest of the casing of the LRTU 500. The Economizer Hood 504 may pivot or adjust its opening based on real-time sensor data, effectively capturing optimal air quantities while preventing the entry of debris or precipitation. This dynamic adjustability may be controlled by an intelligent mechanism that responds to changes in outdoor air conditions, such as temperature, humidity, and air quality.

Within the Economizer Hood 404 or Air Hood 504, a series of high-efficiency filters can be integrated to clean incoming air of particulates and pollutants. These filters are easily accessible for maintenance and can be interchanged with different filtration grades depending on the specific environmental requirements of the installation site.

Furthermore, the Economizer Hood 404 or the Air Hood 504 may include a built-in thermal exchange system, wherein incoming cooler air assists in pre-cooling the refrigerant or air streams within the LRTU 500, enhancing the unit's overall energy efficiency. This feature is particularly advantageous during transitional seasons when the external air temperature is lower than the indoor air temperature, allowing for natural cooling without engaging the unit's compressor.

In addition, the Economizer Hood 404 or the Air Hood 504 may feature solar-reflective surfaces or coatings to prevent excessive heat absorption, and it may be insulated to maintain the desired temperature of the Incoming Air 501. The embodiment may also encompass a smart actuation system that allows the hood to be closed completely, securing the LRTU 500 when outdoor conditions are unfavorable, or when the LRTU 500 is not in use, thus protecting internal components.

Figure 6:
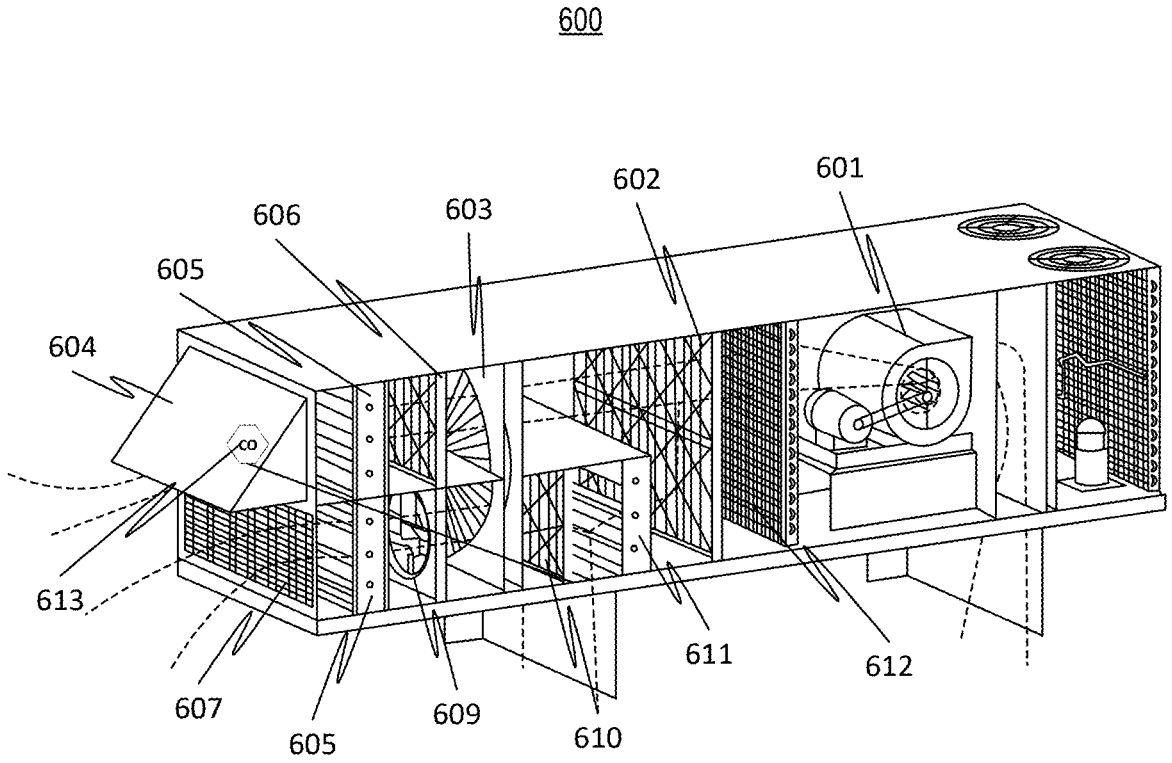
FIG. 6 illustrates an exemplary embodiment of an LRTU with an internal component's layout.

Referring now to FIG. 6, an exemplary view of the internal configuration of the LRTU 600, which may align with the innovative principles of the present apparatus. The depiction illustrates the various components of the LRTU 600 and their functions, emphasizing the efficiency and environmental adaptability of the LRTU 600.

Air may enter the LRTU 600 through the Air Hood 604. An intake in the Air Hood 604 may be equipped with electronic sensors 613 for quantifying environments factors, such as, for example temperature, humidity, and pollutant levels, as digital values. The digital values generated by sensors enables the LRTU 600 to adjust the volume and temperature of the incoming air, optimizing the unit's energy usage.

Air passes through the Exhaust Damper 605, which is a controllable gate dictating airflow into the system, allowing the LRTU 600 to respond to varying ventilation needs dynamically. The initial Filter 606, possibly a high-efficiency particulate air (HEPA) filter, traps fine particles from the incoming air, which is critical for maintaining high indoor air quality.

The Heat Wheel 603 is a pivotal energy recovery component that may capture thermal energy from the exhaust air and transfer it to the incoming fresh air or vice-versa. This process significantly reduces the energy required to bring the incoming air to a comfortable temperature.

Subsequent Filters 602 provide an additional level of air purification before the air reaches Fan 601. The Fan 601 is preferably capable of variable speed operation, and circulates air through the LRTU 600 efficiently, adapting to the system's current load, further contributing to energy savings.

The Exhaust system, comprised of the Exhaust Damper 605 and the Exhaust Fan 609, manages the removal of indoor air through the Grille 607. The Grille 607 is preferably adjustable, allowing for directional control of the airflow to distribute the indoor air outside the building. The Exhaust Damper 605 adjusts the amount of air being expelled, helpful for maintaining the building's pressure balance and air quality.

The Filter 610, positioned strategically within the airflow pathway, may serve a dual-purpose role in some embodiments of the apparatus. While it may primarily act to purify the air being circulated into the building, facilitating a clean and healthy indoor environment, the Filter 610 may also be functional to filter the exhaust air leaving the building. This unique feature may ensure that the LRTU 600 not only protects the internal environment from external pollutants but also minimizes the HVAC system's environmental footprint by cleaning the air before it is released back into the atmosphere.

The Mixing Damper 611 of the LRTU 600 may regulate the blend of fresh outdoor air with the return indoor air within the system. The Mixing Damper 611 may adjust the proportions of air mixed based on the optimal requirements for indoor air quality and temperature control. Its operation is central to the energy efficiency of the LRTU 600, as it can reduce the need for heating or cooling through the Heating/Cooling Coil 612 by taking advantage of the desired properties of the air streams. For example, during cooler periods, the Mixing Damper 611 can allow more warm return air to mix with the cooler fresh air to minimize the heating requirements. The Heating/Cooling Coil 612 adjusts the air temperature to a desired level. The Heating/Cooling Coil's operation is responsive, with the ability to switch between heating and cooling to maintain consistent indoor conditions.

In some embodiments of the apparatus, each part of the LRTU 600 may be designed to work in concert, creating an integrated system that prioritizes energy efficiency, environmental impact, and air quality. The modular design of the LRTU 600 further facilitates easy maintenance and replacement of individual components. Further, unique features of this LRTU 600 may include smart diagnostic systems that monitor the performance of each component and alert maintenance personnel of potential issues before they arise. Additionally, the use of advanced composite materials for components like dampers and filters can further enhance durability and performance while maintaining the comparatively lightweight nature of the unit.

Figure 7:
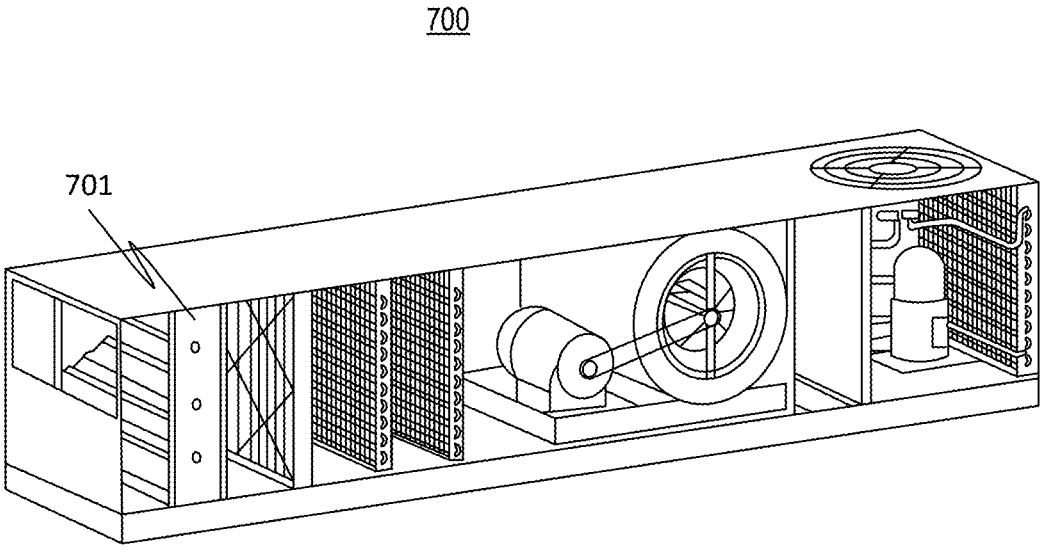
FIG. 7 illustrates an internal view of an LRTU with emphasis on airflow dampers.

Referring now to FIG. 7, an exemplary view of the LRTU 700 in accordance with an embodiment of the apparatus. The LRTU 700 comprises a Damper 701 which is essential for controlling the flow of air into and out of the LRTU 700. The Damper 701 can be adjusted to regulate the volume of air based on the system's needs, thereby enhancing the overall energy efficiency of the LRTU 700. The Damper 701 can be automated, responding to signals from the LRTU's control system (not shown, but housed along with other components within the LRTU 700) that dictate the required airflow based on various factors, such as the internal temperature demand, the quality of the outside air, and the specific operational mode of the HVAC system.

Additionally, the design of the Damper 701 may include a series of airtight seals to prevent energy losses and maintain the integrity of the air being processed. This contributes to the sustainable nature of the LRTU 700, as it facilitates minimal waste of energy during operation.

Figure 8:
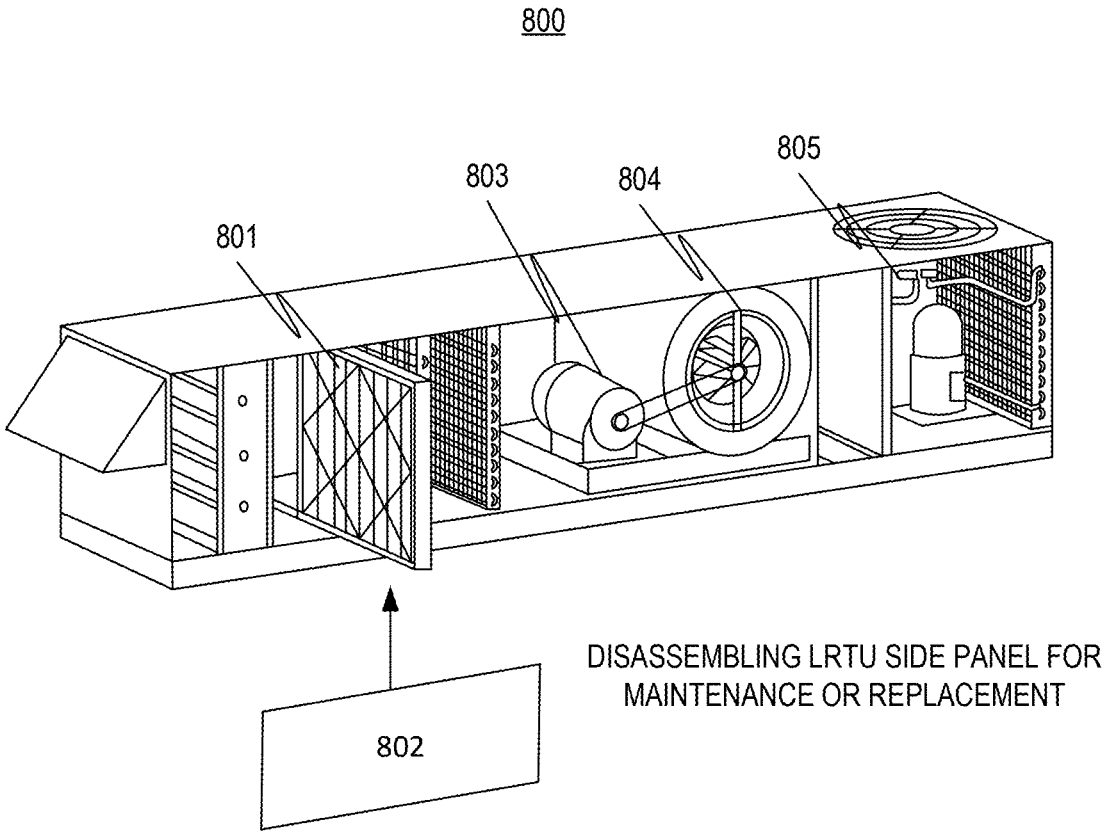
FIG. 8 illustrates an LRTU cross-section highlighting an exemplary multistage filtration process.

Referring now to FIG. 8, an exemplary view of the LRTU 800 in accordance with another embodiment of the apparatus, illustrating its filtration system. The Filters 801 may purify incoming air, removing particulates, allergens, and other airborne contaminants to ensure a high standard of air quality within the building.

The Filters 801 may include multiple stages with different filtration media to address a variety of contaminants. The first stage may consist of a pre-filter for larger particles, followed by higher-grade filters, such as HEPA filters, for fine particulates. This multi-stage approach facilitates comprehensive air purification and contributes to the health and comfort of the building's occupants. Given the modular nature of the LRTU 800 as discussed in the disclosure, the Filters 801 preferably include a size and shape conducive to easy access and maintenance. Filters 801 may be housed in a removable panel or drawer-like component, allowing for quick replacement or cleaning, which aligns with the need for user-friendly operation and serviceability.

The positioning of the Filters 801 at the air intake point further suggests that the LRTU 800 is engineered to address environmental sustainability. By ensuring that the exhaust air is also filtered, the LRTU 800 can minimize the impact on the external environment.

In some embodiments of the present apparatus, the LRTU 800 may facilitate ease of maintenance and component replacement, facilitated through modular side panels that can be readily disassembled. This particular design aspect of the LRTU 800 enhances its serviceability, allowing maintenance personnel to access internal components such as Filters 801 and mechanical parts efficiently, without the need for extensive disassembly of the entire unit. The side panels of the LRTU 800 are engineered to be removed or opened easily via a system of latches or screws that can be operated without specialized tools.

To further facilitate maintenance and ensure safety, the side panels may include safety interlocks that automatically power down the LRTU 800 when a panel is removed. This prevents accidental operation of the LRTU 800 while it is open, thereby protecting maintenance staff from moving parts and electrical components.

Additionally, the interior layout of the LRTU 800 may be thoughtfully designed so that once the side panel 802 is removed, components 804-805 interior to the LRTU 800 are easily accessible. This not only speeds up maintenance and replacement tasks but also reduces the downtime of the unit, which is helpful in environments where constant air conditioning or ventilation is required, such as in commercial or industrial settings. Moreover, the LRTU 800 may include weatherproofing and securing devices for the side panel to hold the side panel in a closed position.

Figure 9:
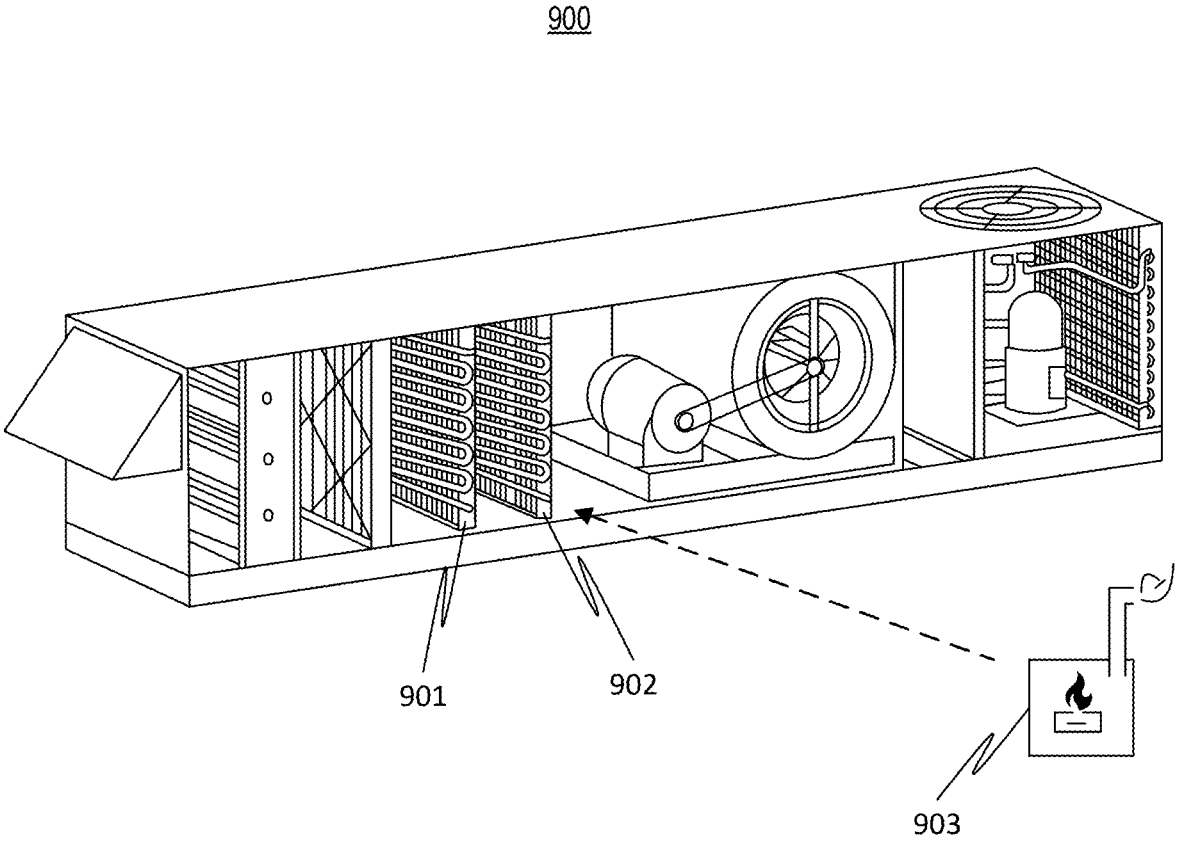
FIG. 9 illustrates LRTU temperature modulation components featuring heating and cooling coils.

Referring now to FIG. 9, an exemplary view of the LRTU 900 in accordance with an embodiment of the apparatus, focusing on the temperature modulation components within the system. A Cooling Coil 901 is designed to reduce the temperature of the air as it flows through the LRTU 900. The Cooling Coil 901 may utilize an eco-friendly refrigerant and advanced materials for enhanced heat exchange efficiency, contributing to the energy-saving features of the LRTU 900. The Cooling Coil 901 may also allow for variable cooling rates, adapting to the current thermal load and external temperatures to optimize energy consumption.

A Heating Coil 902 may also be contained within the LRTU 900. The Heating Coil 902 is operative to raise the temperature of the air passing through the LRTU 900 during colder conditions. The Heating Coil 902 may incorporate technology such as low-emission burners or energy-efficient heat pumps, aligning with the environmentally conscious approach. The modularity of the LRTU 900 allows for both the Cooling Coil 901 and Heating Coil 902 to be more easily accessed for maintenance or replaced as part of the LRTU's serviceable layout. Both the Cooling Coil 901 and the Heating Coil 902 may be operated upon command (such as, for example, by a controller) to maintain the desired indoor environment, responding to the demands set by the integrated control system of the LRTU 900. The integrated control system can manage the operation of the Heating and Cooling Coils 901-902 based on inputs from various sensors, ensuring that indoor temperature and humidity levels remain comfortable for occupants.

In some embodiments, an Indirect Burner 903 may be incorporated into the LRTU 900 to provide an efficient means of heating. The Indirect Burner 903 may operate by transferring heat through a heat exchanger rather than directly exposing the air to combustion gases. This method may ensure that the air circulated within the building remains free of combustion by-products, enhancing indoor air quality and safety. The Indirect Burner 903 can utilize various fuels, such as natural gas, propane, or biofuels, aligning with the environmentally conscious principles of the LRTU 900.

Figure 10:
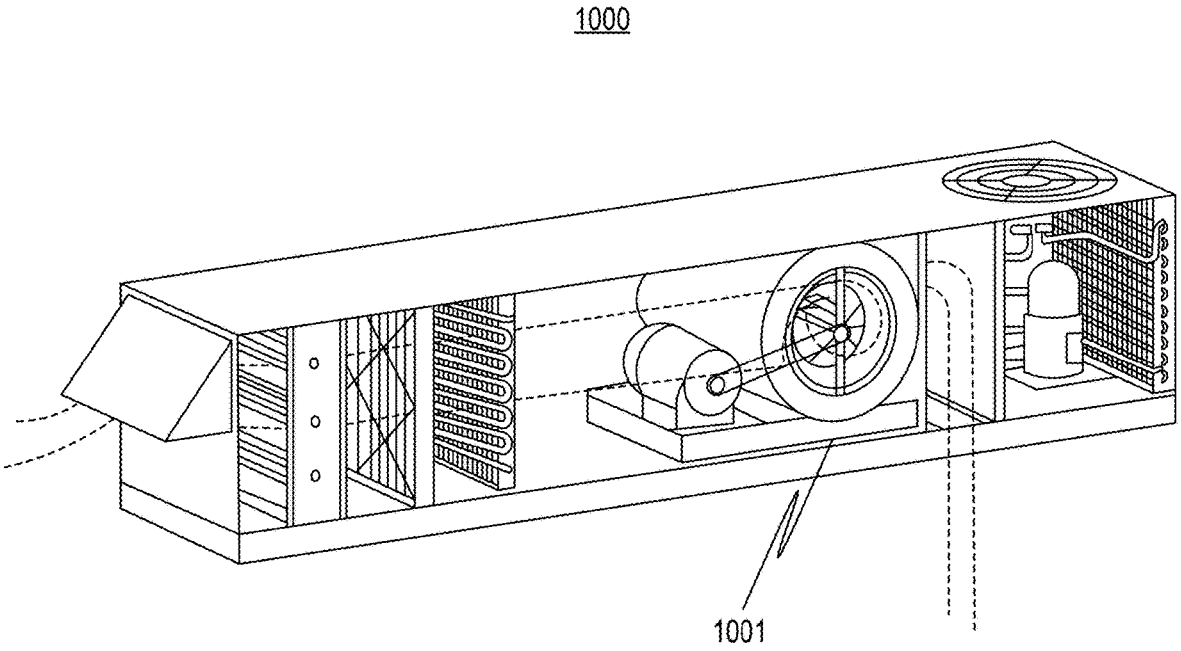
FIG. 10 illustrates an LRTU's centrifugal EC fan and associated airflow mechanics.

Referring now to FIG. 10, an exemplary view of the LRTU 1000 in accordance with an embodiment of the apparatus, illustrating a Centrifugal EC (Electronically Commutated) Fan 1001. This Centrifugal EC Fan 1001 facilitates air movement through the LRTU 1000 for both heating and cooling processes.

The Centrifugal EC Fan 1001 is chosen for its energy-efficient operation and its ability to provide variable airflow. Electronically commutated motors are known for their high efficiency, especially when compared to traditional motors, as they can adapt their speed to the system's demand, significantly reducing power consumption. The Fans can be optimized for quiet operation, which is desirable for maintaining a comfortable environment both inside and outside the building. Additionally, in some embodiments, a Centrifugal EC Fan 1001 works effectively against the resistance caused by ductwork and filters within the LRTU 1000, providing consistent airflow and pressure throughout the system.

Figure 11:
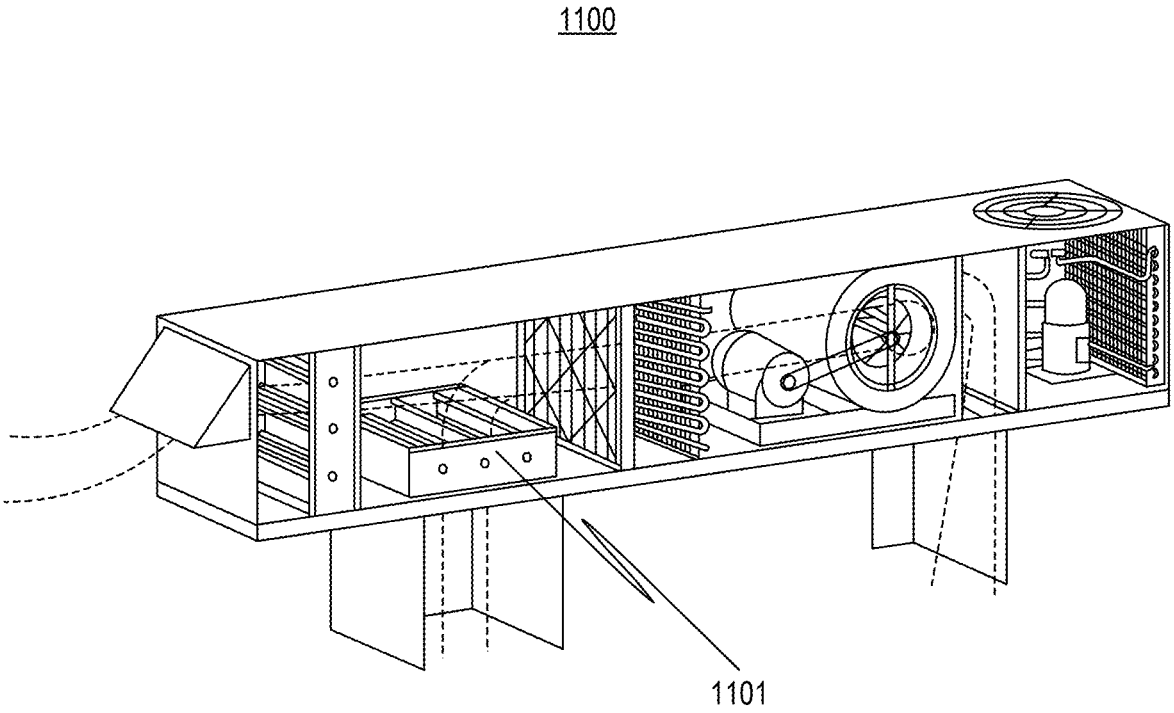
FIG. 11 illustrates operational dynamics of an LRTU with an open damper for air recirculation.

Referring now to FIG. 11, an exemplary view of the LRTU 1100 in accordance with an embodiment of the apparatus, a Damper 1101 is illustrated in a "Damper Open" position. This Damper 1101 provides additional LRTU energy-efficiency and allows for the modulation of air circulation to minimize heating requirements when conditions permit.

The Damper 1101 can adjust to allow for the recirculation of air within the system. By recirculating warmer indoor air, instead of solely relying on outside air that may be cooler, the LRTU 1100 can reduce the demand on its heating components. This is especially beneficial during periods of mild outdoor temperatures, where the need for additional heating is lessened, thereby conserving energy, and reducing operational costs. In "Damper Open" mode, the system can accept fresh air intake based on specific requirements and considering the differential between indoor-outdoor temperatures. During this mode, the system can also recirculate the air as needed to minimize heating or cooling requirements.

The capacity of the Damper 1101 to recirculate air also demonstrates the responsiveness of the LRTU 1100 to the internal climate conditions of the building, dynamically adjusting to maintain comfort levels with optimal energy usage. This process can be managed automatically by the control system of the LRTU 1100, which may process data from temperature sensors within the building to make real-time adjustments to the positions of the Damper 1101.

The Damper 1101 demonstrates an innovative design that may contrast with the Exhaust Damper 605 as shown in FIG. 6. The Damper 1101 represents a design where the Damper 1101 can be adjusted to an open position, allowing for the recirculation of indoor air. This recirculation is a strategic function that takes advantage of the thermal energy already present within the building's environment, thereby minimizing the need for additional heating and reducing energy consumption.

In comparison, the Exhaust Damper 605 in FIG. 6 may include a size and shape providing efficient expulsion of air from the building's interior. The Damper's 605 operation may typically involve releasing stale air and maintaining air quality, it may also contribute to heating efficiency of the LRTU 600.

The size, shape, and placement of the Damper 1101 may allow for a more dynamic and responsive air handling strategy within the LRTU 1100. When the indoor temperature is higher than the outside air temperature, the Damper 1101 opens to recirculate the warmer indoor air, thus conserving heat and reducing the demand on the heating coil. The control systems for both Dampers (1101 & 605), although not detailed in the Figures, may likely be different. The control system for the Recirculating Damper 1101 may be responsive to temperature variations and capable of precise modulation to balance indoor air temperature efficiently. The control system for the Exhaust Damper 605 may be simpler, focusing on air quality parameters and possibly building pressurization.

Figure 12:
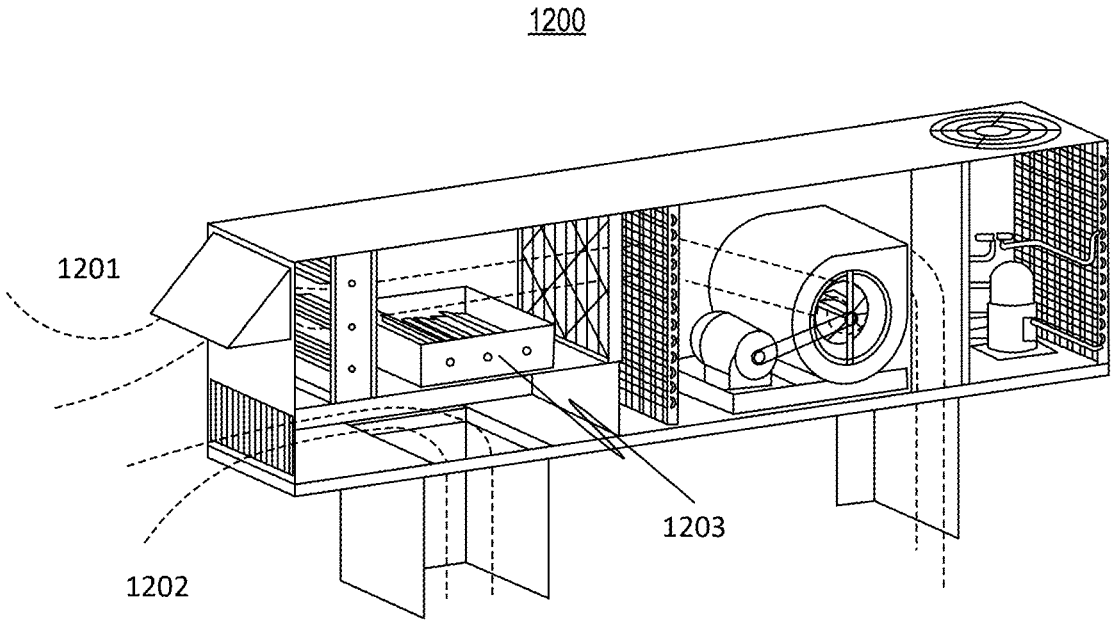
FIG. 12 illustrates an LRTU air management system with a closed damper and fresh air intake.

Referring now to FIG. 12, an exemplary view of the LRTU 1200 in accordance with an embodiment of the apparatus. It specifically details the air management pathways within the HVAC system. The Fresh Air Intake 1201 through an Air Hood (e.g., 504) is a component that indicates where outside air enters the LRTU 1200. This air intake may include filtration and possibly pre-heating or pre-cooling functions as part of the energy-efficient design of the LRTU 1200 processes.

The Return Air Exhaust 1202 is where the indoor air, which has been circulated through the building and is now being exhausted, exits the LRTU 1200. The Return Air Exhaust 1202 may incorporate energy recovery systems to retain some of the thermal energy from the exhaust air, which may then be transferred to the incoming fresh air to improve overall efficiency.

The Damper 1203 having a specific placement feature "Damper Closed" (when compared to the Damper Open feature of the Damper 1101 as discussed in FIG. 11), illustrates a mode where the LRTU 1200 is not taking in outside air and is recirculating the indoor air. This may be used during peak heating or cooling periods when the outside air temperature is far from the desired indoor conditions, or when the air quality outside is poor. In this mode, the LRTU 1200 may rely solely on its internal heating and cooling mechanisms to maintain the indoor climate.

The integration of Dampers (1101 or 1203) in the LRTUs (1100 or 1200) suggests a level of control and adaptability in the operation of the LRTUs (1100 or 1200). The system can modify the balance of fresh air to return air to optimize air quality and energy usage. These dampers may be part of modular design components assembled to form the LRTUs (1100 or 1200), allowing for easy access and maintenance, consistent with the emphasis on serviceability described throughout the present disclosure.

In an embodiment of the apparatus, an LRTU (1100 or 1200) may incorporate an advanced Damper mechanism (1101 or 1203) capable of automatic or manual modulation to optimize environmental conditions within a building. The LRTU (1100 or 1200) features a sophisticated control system integrated with sensors that continuously monitor various parameters such as indoor air quality, temperature, humidity, and outdoor air conditions.

In some embodiments of the apparatus, the Dampers (1101 or 1203) play a helpful role in regulating the airflow within the LRTU (1100 or 1200). Dampers (1101 or 1203) can be automatically adjusted to either an open or closed position, dictating the flow of air based on real-time data collected by the sensors. For example, when the indoor air temperature is lower than desired, the Dampers (1101 or 1203) may automatically close, reducing the intake of cooler outside air and enabling the system to efficiently recirculate and warm the indoor air. Conversely, if the sensors detect that the indoor air quality is compromised or the indoor air temperature exceeds the desired threshold, the Dampers (1101 or 1203) can open to allow fresh outside air to enter, facilitating the dilution of indoor pollutants and assisting in temperature control.

Operation of the Damper (1101 or 1203) may not solely be reliant on automation. Users have the capability to manually override the automatic settings, providing flexibility in operation. This can be particularly useful in scenarios where specific ventilation requirements are needed, such as in response to occupancy changes or particular indoor activities that may affect air quality or temperature.

Moreover, the LRTU (1100 or 1200) can operate in various modes, depending on the positions of the Damper (1101 or 1203). In the 'Damper Open' mode, the system prioritizes fresh air intake, which is essential for maintaining air quality and managing internal CO2 levels. In the 'Damper Closed' mode, the emphasis is on air recirculation, which is energy efficient and can be beneficial for maintaining consistent thermal conditions within the building.

The LRTU (1100 or 1200) can dynamically adjust to the least energy-intensive operation required to maintain comfort. Additionally, it contributes to the building's environmental sustainability by reducing the need for mechanical heating or cooling when the external conditions are favorable for natural ventilation or air recirculation. The inclusion of user control facilitates adaptability of the LRTU (1100 or 1200) to the diverse and changing needs of the building's occupants, providing a responsive and user-friendly climate control solution.

In some embodiments of the apparatus, an LRTU (1100 or 1200) suitable for roof-mounted applications on commercial buildings or positioned proximally may provide fluid communication with an internal HVAC system. The LRTU (1100 or 1200) and its associated components deliver heating, cooling, and ventilation to spaces within the associated building.

The cooling process within the LRTU (1100 or 1200) involves drawing air from the building's interior into the LRTU (1100 or 1200). This air passes through filters, removing particulates, and then flows over cooling coils. Inside these coils, a refrigerant absorbs heat from the air, thereby cooling it. The refrigerant circulates to an external cooling unit, and the cooled air is then distributed back into the building through ductwork.

Figure 13:
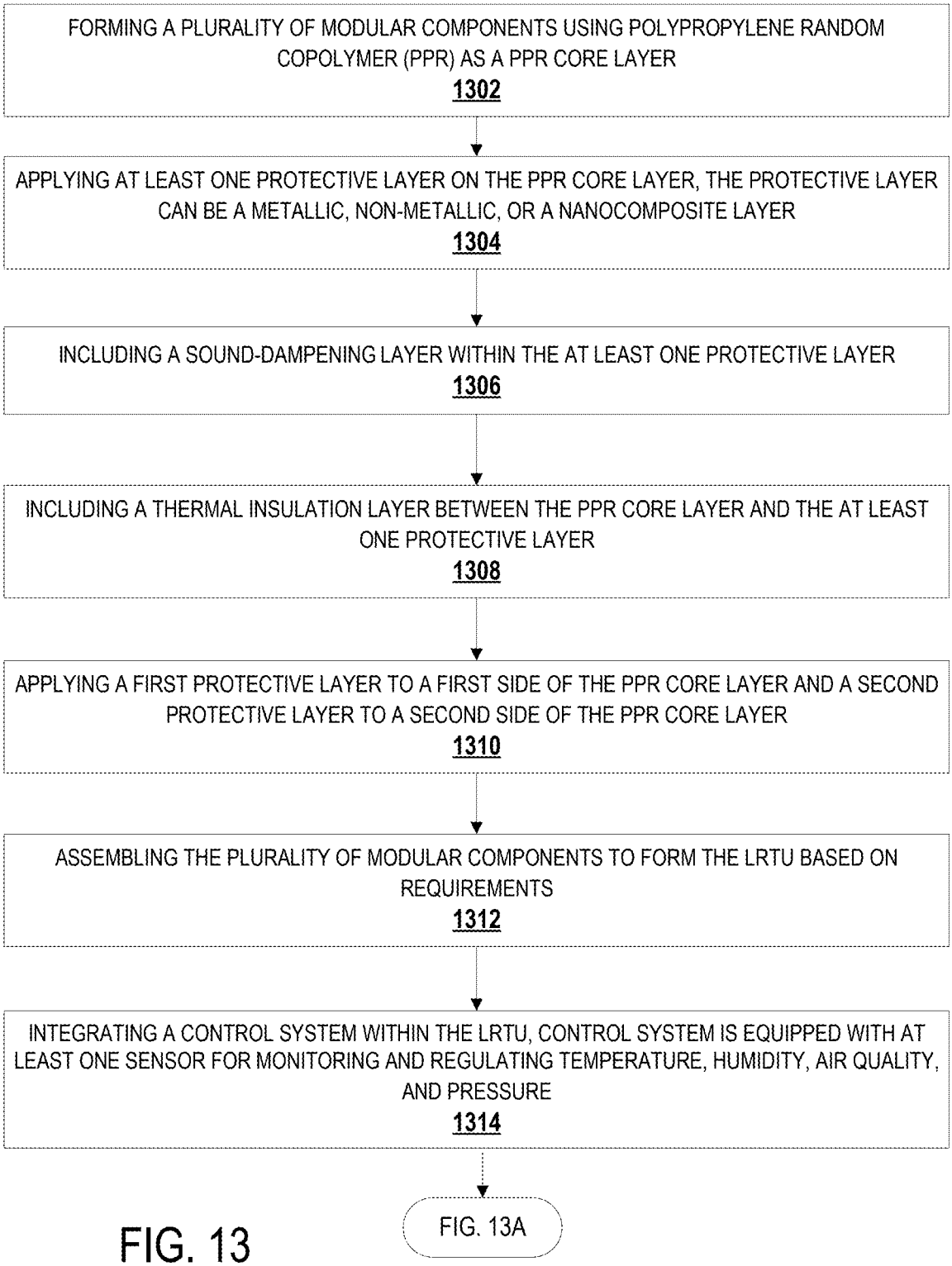
FIGS. 13 and 13A illustrate exemplary method steps for manufacturing and setting up an LRTU for an HVAC system of the present disclosure.
Figure 13A:
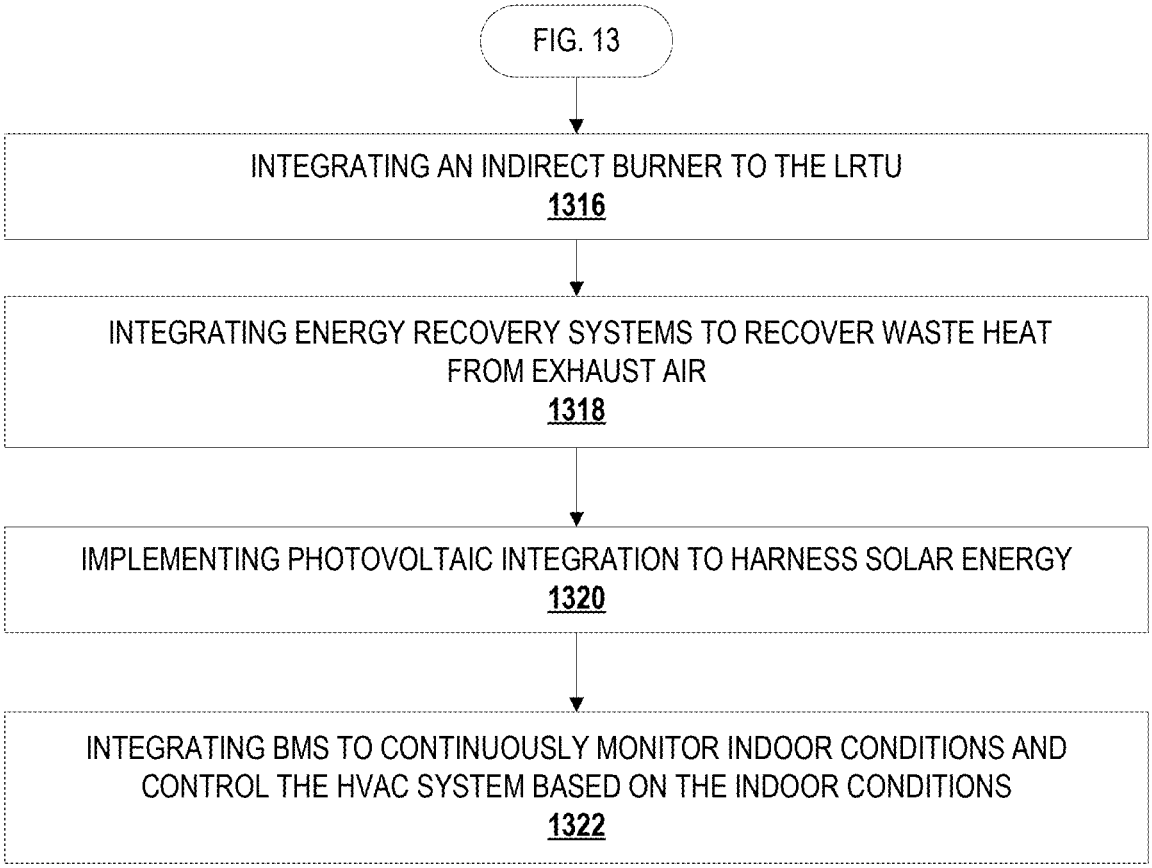

Referring now to FIGS. 13 and 13A, the method steps for manufacturing and setting up an LRTU for HVAC systems according to some embodiments of the present apparatus are presented. At method step 1302, the manufacturing process of the LRTU begins with the formation of a plurality of modular components (casing panels) using Polypropylene Random Copolymer (PPR) to establish a robust PPR core layer. This step lays the groundwork for the unit, as PPR is chosen for its excellent combination of durability, lightweight properties, and environmental friendliness, making it an ideal base material for the innovative LRTU.

At method step 1304, the next phase involves applying at least one protective layer onto the previously formed PPR core layer. The protective layer(s) serves as a primary defense against the environmental stressors and can be composed of various materials, including metallic substances like aluminum, non-metallic UV-resistant polymers, or cutting-edge nanocomposite coatings. The choice of material allows for customization based on specific environmental requirements and is helpful for enhancing the unit's durability and longevity.

At method step 1306, a sound-dampening layer is included within the protective layer. This addition is particularly important for urban and residential settings where HVAC noise can be intrusive. The sound-dampening layer works to absorb and minimize the operational sounds produced by the LRTU, ensuring a quieter and more comfortable environment for the building's occupants during installation or working of the LRTU.

At method step 1308, a thermal insulation layer is incorporated between the PPR core layer and the protective layer(s). This insulating layer plays a significant role in the energy efficiency of the LRTU, helping to maintain internal temperature regulation and reduce energy costs by minimizing thermal exchange with the external environment.

At method step 1310, the method evolves to apply a first protective layer to one side of the PPR core layer and a second protective layer to the opposite side, forming a "sandwich" structure that encases the PPR core. This dual-layer configuration not only strengthens the core layer but also provides additional insulation and protection, allowing for a higher degree of environmental adaptability and resilience.

At method step 1312, the various modular components created and treated in the preceding steps are assembled to form the complete LRTU. The modular nature of these components allows for a streamlined assembly process and offers flexibility for future maintenance and upgrades, accommodating the evolving needs of the HVAC system and the building it serves.

At method step 1314, an integrated control system equipped with sophisticated sensors may be integrated within the LRTU. These sensors are helpful for monitoring and regulating the internal conditions of the unit, including, but not limited to, temperature, humidity, air quality, and pressure. The control system facilitates operation of the LRTU at peak efficiency, adapting its performance to real-time environmental data to maintain optimal indoor conditions.

At method step 1316, an indirect burner may be integrated into the LRTU system to enhance its heating capabilities. The indirect burner, strategically positioned within the unit, operates by transferring heat through a heat exchanger, rather than directly mixing combustion gases with the circulated air. This setup may be useful for maintaining air quality and safety within the building, as it prevents any combustion by-products from entering the living or working spaces. The use of such a burner is particularly beneficial in colder climates or in applications where additional heating may be necessary beyond the capabilities of traditional HVAC systems.

To facilitate this integration, the LRTU may include a compartment that houses the burner securely, ensuring that it does not interfere with other HVAC components. The placement is carefully calculated to optimize airflow and heat transfer within the unit. The heat generated by the burner is efficiently transferred to the air stream through the heat exchanger, significantly improving the heating efficiency without compromising the energy consumption. The choice of fuel for the indirect burner may include options such as natural gas, propane, or biofuels, allowing for flexibility depending on local availability and environmental regulations.

Furthermore, the integration of the indirect burner may be modular, in line with the rest of the LRTU components. This modularity may allow for easy maintenance and potential upgrades or replacements of the burner unit without the need for extensive disassembly of the LRTU. It facilitates adaptation of the LRTU to future advancements in heating technology or changes in fuel types without extensive overhauls.

At method step 1318, the LRTU may comprise integration of Energy Recovery Systems to significantly enhance the unit's energy efficiency. This step involves incorporating systems that recover waste heat from exhaust air and use it to condition incoming fresh air, which may reduce the energy required for heating or cooling the air to the desired indoor temperature.

The integration begins with the selection of an appropriate energy recovery technology. Options may include heat wheels, plate heat exchangers, and energy recovery ventilators (ERVs). Each technology has its own set of advantages and may be chosen based on factors such as the building's air quality requirements, the climatic conditions, and the energy efficiency targets. For example, heat wheels are highly effective in both transferring heat and moisture, making them ideal for environments where humidity control is also a concern.

Following the selection, the chosen energy recovery device may fit into the LRTU architecture. The device preferably does not impede the airflow and integrate well with other system components such as fans and filters. The placement is strategic to maximize heat recovery from the exhaust stream while minimizing pressure drops in the system.

The installation of the energy recovery device may involve configuring it to work in tandem with the HVAC system's control unit. The configuration may allow the system to dynamically adjust the operation of the recovery unit based on real-time data from the HVAC system, such as temperature, humidity levels, and airflow rates. This adaptability is helpful for maintaining optimal indoor air conditions and for maximizing energy savings.

Moreover, the system may be equipped with sensors that monitor the performance of the energy recovery unit, ensuring it operates within its optimal parameters. These sensors may help in identifying any efficiency losses or operational issues early, allowing for timely maintenance and adjustments.

At method step 1320, the LRTU may comprise implementing photovoltaic integration in the unit's sustainability features. The step involves integrating solar panels with the LRTU to harness solar energy, thereby reducing reliance on traditional energy sources, and promoting greater energy self-sufficiency.

The integration begins with the selection of suitable photovoltaic (PV) panels that efficiently convert sunlight into electrical energy. The selection process considers factors such as the geographic location, the typical sun exposure of the installation site, and the energy requirements of the LRTU. High-efficiency solar panels are chosen to maximize energy capture even in less-than-ideal lighting conditions.

Following the selection, the solar panels are strategically positioned on the top or sides of the LRTU casing, depending on the available surface area and orientation for optimal sun exposure. The strategic installation is helpful to facilitate optimal function where the panels do not interfere with the unit's other functions, such as air intake or exhaust. Special mounting systems may be used to secure the panels while allowing for easy access for maintenance or adjustments.

The electrical integration of the solar panels with the LRTU's power system involves installing power inverters that convert the direct current (DC) generated by the solar panels into alternating current (AC), which can be used by the LRTU or fed back into the building's power grid. Additionally, the system may include energy storage solutions, such as batteries, to store excess energy generated during peak sunlight hours. This stored energy can be utilized during periods of low light or at night, ensuring a consistent energy supply and enhancing the unit's overall energy independence.

Finally, at method step 1322, the LRTU may be integrated with the Building Management System (BMS) of the building where the LRTU is to be installed. This integration is pivotal for enhancing operational efficiency and environmental control within the building and it involves setting up a comprehensive BMS that continuously monitors indoor conditions and automatically adjusts the HVAC system to optimize the indoor environment.

The integration process may start with the installation of a network of sensors throughout the building. These sensors quantify a variety of environmental parameters including temperature, humidity, CO2 levels, and air quality as one or both of analog and digital values. By providing real-time data on these conditions, the sensors enable the BMS to make informed decisions about HVAC operations.

Once the sensors are in place, they are connected to a centralized BMS controller. The controller may serve as the brain of the HVAC system, processing data from the sensors to assess the current indoor environment. In some embodiments, the controller transmits that data to the LRTU control system for further controlling the HVAC system based on the sensed data. The LRTU control system may be programmed with algorithms that interpret this data and determine the most efficient HVAC settings to maintain optimal indoor conditions. For example, if the sensors detect an increase in indoor temperature or CO2 levels beyond set thresholds, the LRTU control system can automatically adjust the air conditioning settings or increase ventilation to restore comfort and air quality.

The BMS may also be integrated with other building systems such as lighting and security to further enhance efficiency and safety. For example, the LRTU control system can turn off HVAC in unoccupied rooms or adjust the climate control settings based on occupancy patterns detected by the security system. Additionally, the LRTU control system may include predictive maintenance features. By analyzing historical data and current performance metrics from the HVAC system, the LRTU control system can predict potential system failures or maintenance needs before they occur.

In some embodiments of the apparatus, to enhance the user experience and environmental compatibility, the LRTU may include several additional features:

A sound-dampening layer within the protective layers, significantly reducing operational noise.

An automated alert system within the control system, providing maintenance reminders and fault detection.

An economizer component, contributing to energy-efficient cooling by leveraging external cool air when conditions allow.

Integration of photovoltaic cells, offering auxiliary power generation to supplement the LRTU's energy needs.

A thermal insulation layer placed between the PPR core and the protective layers, improving energy efficiency by maintaining internal temperature stability.

Furthermore, vibration isolation features may be incorporated into the LRTU. These features minimize the transfer of vibrations to the building structure, thereby reducing noise and potential wear on the unit.

In some embodiments of the apparatus, in the manufacturing method for an LRTU, the production of the unit's modular panels is accomplished through a diversified approach, utilizing different modalities of manufacturing processes to cater to the varying size and complexity of the components.

For larger portions (large size modular panels) of the LRTU, the method may include the process of extrusion, where Polypropylene Random Copolymer (PPR) is meticulously extruded onto a thin layer of galvanized steel. This method combines the lightweight and durable properties of PPR with the strength and environmental resistance of galvanized steel, resulting in panels that are robust yet not excessively heavy, thus contributing to the overall structural integrity of the LRTU, without significantly increasing the load on the building's roof.

Conversely, smaller and more intricate portions (small size modular panels) of the LRTU may be manufactured using precision techniques such as injection molding and 3D printing. These processes allow for the creation of detailed and complex shapes that may be difficult to achieve with traditional manufacturing methods. Injection molding is particularly effective for producing high volumes of consistent, high-quality parts with intricate geometries. Meanwhile, 3D printing offers the flexibility to produce custom or unique shapes that may be required for specific functional or aesthetic purposes within the LRTU.

Once formed, these smaller components are often coated with a metallic layer, which may be a spray-applied metal coating, or a thin metallic film adhered to the surface. This metallic coating not only serves to protect the PPR from UV radiation, moisture, and other environmental factors but also can provide additional structural reinforcement, thermal insulation, and even aesthetic appeal depending on the chosen metal and application technique.

The distinct manufacturing techniques for different modular panels allow for each component to be optimized for its specific role within the LRTU, ensuring that the final assembled LRTU is a harmonious integration of parts that provides maximum functionality, durability, and efficiency.

Figure 14:
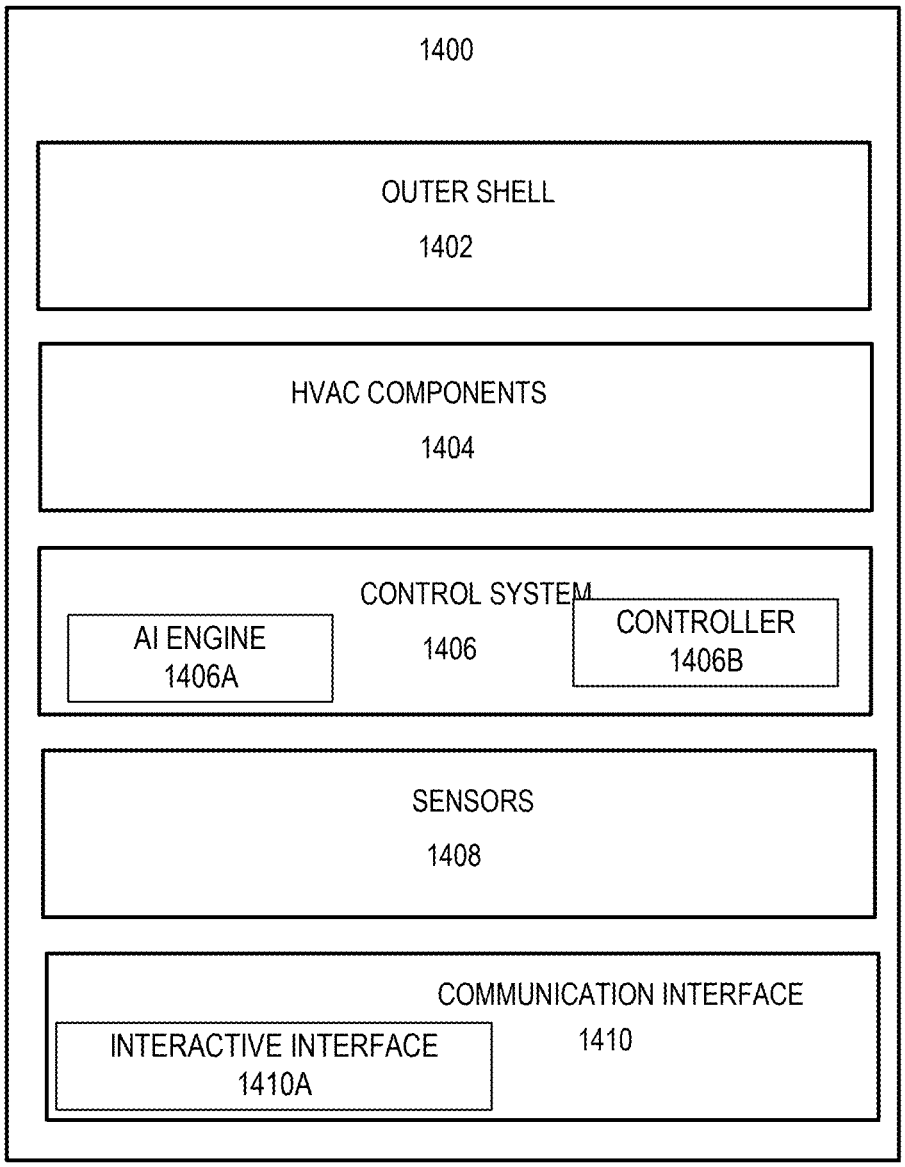
FIG. 14 illustrates an exemplary block diagram of an LRTU system for an HVAC system.

Referring now to FIG. 14, an exemplary block diagram of an LRTU 1400, with innovative features included in the present apparatus. FIG. 14 illustrates a few of the primary components and systems that the LRTU 1400 may include, showcasing sophisticated structure and functionality of the LRTU 1400. In some embodiments, a number of other components may also be integrated within the LRTU 1400.

The Outer Shell 1402 represents a durable exterior of the LRTU 1400, including a PPR core layer intricately bonded with various protective layers. These layers have been elaborated upon across various embodiments of the apparatus. This advanced, composite construction of the Outer Shell 1402 facilitates defense of the LRTU 1400 against a multitude of environmental challenges, including extreme weather conditions, UV exposure, and physical impacts, thereby ensuring the longevity and reliability of the LRTU 1400.

HVAC Components 1404 constitute the core operational elements of the HVAC system housed within the LRTU 1400, encompassing a broad array of parts helpful in the function of its multi-faceted climate control capabilities. This may include, but is not limited to, precision dampers that regulate airflow, advanced heating and cooling coils that facilitate effective temperature modulation, and strategically placed fans that provide optimal air circulation throughout the system. Additionally, the component suite features high-efficiency air filtration units, such as HEPA filters, which are instrumental in purifying the air by trapping fine particulates and maintaining superior air quality. The HVAC components may also integrate an economizer for harnessing external air for cooling under suitable conditions, variable frequency drives for energy-efficient operation of motors, and a refrigeration circuit complete with compressors and expansion valves that play a pivotal role in the thermodynamic processes of the LRTU 1400.

The Control System 1406 serves as the sophisticated brain of the LRTU 1400, adeptly managing and synthesizing data from an array of sensors to orchestrate the unit's operations. The Control System 1406 facilitates the maintenance of optimal indoor environmental conditions by dynamically adjusting HVAC components in response to real-time feedback from various sensors. The Control System 1406 may optimize energy use while maintaining comfort, integrating advanced algorithms for predictive maintenance and adaptive response to changing conditions. The Control System 1406 may also be seamlessly integrated with building management systems (BMS), facilitating remote monitoring, diagnostics, and control, which allows for pre-emptive adjustments and swift resolution of potential issues. Furthermore, it supports user interfaces that enable customized settings and preferences, ensuring that the LRTU 1400 operates not only with precision but also with a high degree of user-friendly interactivity.

In some embodiments, the Control System 1406 of the LRTU may comprise an Artificial Intelligence (AI) Engine 1406A operative to control performance of the HVAC system by intelligently controlling heating, cooling, and ventilation based on real-time and predicted environmental and operational requirements.

The AI Engine 1406A within the Control System 1406 may be equipped with advanced machine learning algorithms capable of processing vast amounts of data from various Sensors 1408 embedded throughout the HVAC system. These Sensors 1408 may collect data on temperature, humidity, air quality, occupancy levels, and external weather conditions. By analyzing this data, the AI Engine 1406A is operative to generate logical commands, comprising one or both of electrical and digital transmissions to adjust the heating, cooling, and airflow settings in real-time, controlling indoor climate conditions and increasing energy efficiency.

In some embodiments, the AI Engine 1406A may learn from historical data and identify trends in system performance and environmental conditions. For example, the AI can learn typical occupancy patterns within a building and adjust the HVAC operations to ramp up heating or cooling shortly before occupants arrive, or scale back during off-hours or when the building is unoccupied. This predictive capability may allow for more proactive management of the HVAC system, reducing energy waste and improving the overall comfort levels for building occupants.

Furthermore, the AI Engine 1406A may be programmed to continuously monitor the performance of the HVAC components, such as the efficiency of the heating coils, the operational health of the cooling system, and the integrity of the ventilation pathways. By detecting anomalies or deviations from expected performance benchmarks, the AI Engine 1406 can trigger maintenance alerts, recommending preventive maintenance or urgent repairs, thereby avoiding costly downtimes and extending the lifespan of the equipment.

The Control System 1406, through its AI Engine 1406, may also interface with other building management systems (BMS) to ensure holistic management of the building's utilities and services. This integration may allow the AI Engine 1406 to consider additional factors such as energy consumption patterns, security systems, and even external data feeds like weather forecasting services, to dynamically adjust the HVAC operations, further enhancing the building's efficiency and the comfort of its occupants.

In addition to operational control, the AI Engine 1406 may incorporate user-friendly interfaces that allow building managers and maintenance personnel to interact with the system. Through an interactive user interface, a user may view detailed reports, including, for example, one or more of: system performance, energy usage, and receive real-time notifications on any issues or adjustments made by the AI. In some embodiments, a user may interact with the interactive user interface to manually override AI decisions, providing flexibility and human oversight to the automated system.

Sensors 1408 are the LRTU's sensory organs, encompassing devices such as temperature sensors to monitor heat levels, pressure sensors to maintain optimal airflow, and air quality sensors to detect and respond to the presence of pollutants or particulates. Temperature sensors constantly assess thermal conditions, ensuring the system responds effectively to maintain desired heat levels. Pressure sensors play a helpful role in managing airflow dynamics within the HVAC system, maintaining an equilibrium that maximizes efficiency and comfort. Air quality sensors are helpful in detecting a spectrum of pollutants, from volatile organic compounds to particulate matter, triggering the Control System 1406 to initiate appropriate filtration and ventilation responses. Additionally, humidity sensors maintain balanced moisture levels, critical for both comfort and the prevention of mold and mildew. Together, these sensors form an integrated network that feeds real-time data to the Control System 1406, enabling the LRTU 1400 to adapt its operations to the ever-changing indoor environment, thus preserving a healthy and comfortable atmosphere. Apart from these Sensors 1408, there can also be various other sensors integrated to the LRTU 1400.

Communication Interface 1410 is the gateway for external communication, facilitating remote control, integration with Building Management Systems (BMS), integration with a cloud server, and transmitting alerts for maintenance or repair needs, thus allowing for smart, responsive management of the HVAC system. The seamless remote control allows facility managers or occupants to adjust settings and respond to HVAC needs from afar. Integral to smart building operations, it provides robust integration with Building Management Systems (BMS), ensuring synchronized and harmonized control across various building systems for enhanced efficiency and comfort. The Communication Interface 1410 is also responsible for broadcasting timely maintenance and repair alerts, which are essential for proactive system management and minimizing downtime. Moreover, it supports the transmission of performance data to cloud-based analytics platforms, allowing for the utilization of big data and AI-driven insights for predictive maintenance and energy optimization strategies. In essence, the Communication Interface 1410 is pivotal in transforming the LRTU 1400 into an intelligent, interactive component of the modern, smart building ecosystem.

Further, the LRTU 1400 may integrate a suite of additional components (not shown) to elevate its operational efficiency and sustainability. An Economizer may ingeniously be incorporated to exploit cooler external air for natural ventilation, substantially curtailing energy expenditure during suitable weather conditions. Photovoltaic Solar Cells may strategically be embedded to capture solar energy, thus supplementing the power supply of the LRTU 1400 and underscoring its commitment to renewable energy utilization. A Rainwater Harvesting System may be included to collect and repurpose rainwater, aligning with sustainable water resource practices and contributing to the building's eco-friendly initiatives. The system may also include a Condensate Drainage system that facilitates effective management and disposal of moisture accumulation, a byproduct of the cooling process, thereby preventing potential water damage and maintaining system integrity. To ensure reliable operation, the LRTU 1400 may be outfitted with versatile Power Supplies that can seamlessly switch between conventional grid electricity and alternative energy sources, providing uninterrupted service and energy resilience. Interactive Interfaces 1410A may thoughtfully be developed, featuring intuitive touchscreens or tactile buttons, allowing end-users to effortlessly interact with the system for manual adjustments, personalized settings, and system diagnostics, thereby offering a user-centric approach to HVAC system management.

Figure 15:
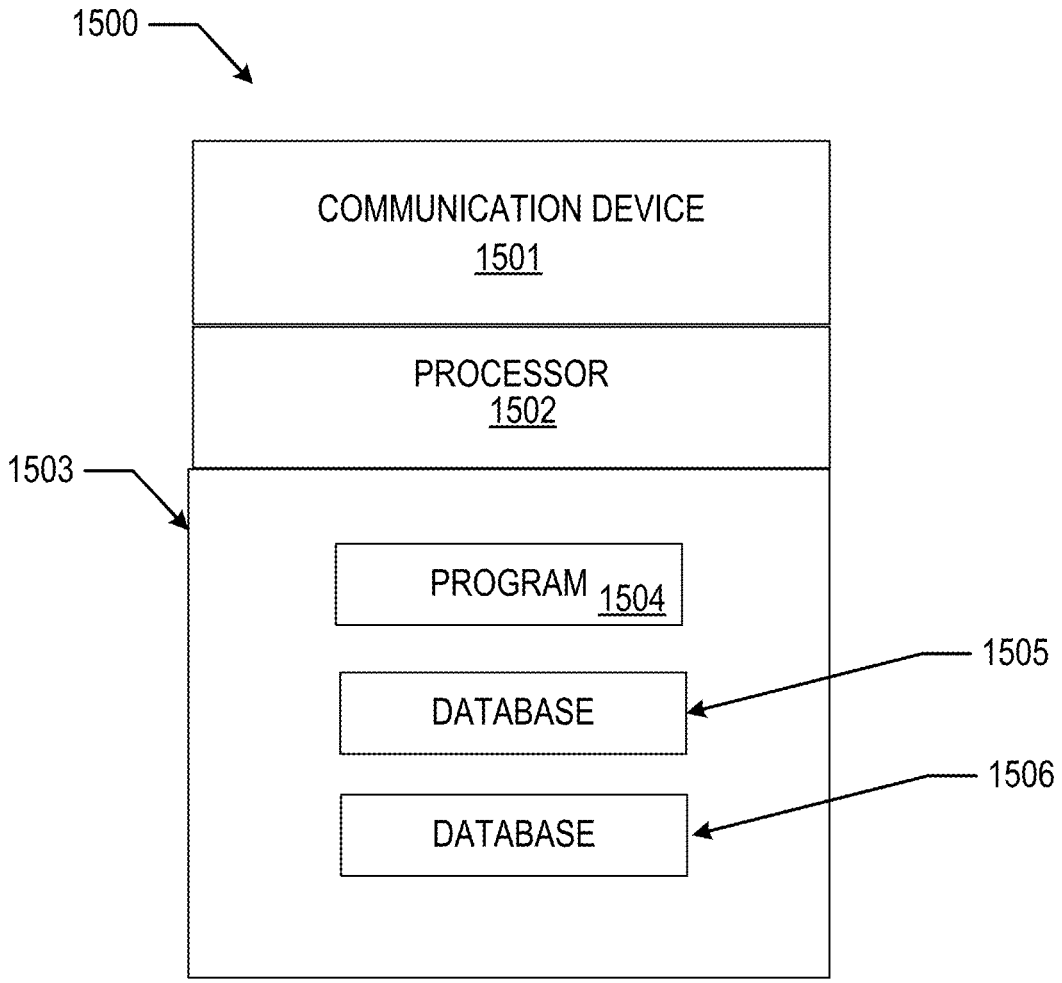
FIG. 15 illustrates an exemplary block diagram of a Control System.

Referring now to FIG. 15, an automated Controller 1500 is illustrated that may be used to implement various aspects of the present apparatus in various embodiments, and for various aspects of the present apparatus. Controller 1500 may be included in one or more of: a wireless tablet or handheld smart device, a server, an integrated circuit incorporated into a Node, appliance, equipment item, machinery, or other automation. The Controller 1500 includes a Processor Unit 1502, such as one or more semiconductor-based processors, coupled to a Communication Device 1501, configured to communicate via a communication network (not shown in FIG. 15). The Communication Device 1501 may be used to communicate, for example, with one or more online devices, such as a smart device, a Node, personal computer, laptop, or a handheld device.

The processor unit 1502 is also in communication with a Storage Device 1503. The Storage Device 1503 may comprise any appropriate information storage device, including combinations of digital storage devices (e.g., an SSD), optical storage devices, and/or semiconductor memory devices such as Random Access Memory (RAM) devices and Read Only Memory (ROM) devices.

The Storage Device 1503 can store a Software Program 1504 with executable logic for controlling the Processor Unit 1502. The Processor Unit 1502 performs instructions of the Software Program 1504, and thereby operates in accordance with the present apparatus. The Processor Unit 1502 may also cause the Communication Device 1501 to transmit information, including, in some instances, timing transmissions, digital data, and control commands to operate apparatus to implement the processes described above. The Storage Device 1503 can additionally store related data in a Database 1505 and Database 1506, as needed.

In some embodiments of the apparatus, cooling components that may be housed in an LRTU may include one or more Compressors that drive the refrigeration cycle. The compressors are operative to compress low-pressure, low-temperature refrigerant gas, turning it into high-pressure, high-temperature gas; Condenser Coils where high-temperature refrigerant gas releases its heat to the outside atmosphere, turning it into high-pressure liquid; Expansion Valves that transform high-pressure liquid refrigerant into a low-pressure, low-temperature liquid; Evaporator Coils positioned to have air from the building pass over Evaporator Coils, such that refrigerant inside Evaporator Coils absorbs heat from the air, cooling the air, wherein the refrigerant evaporates, turning back into a low-pressure gas; Blower Fans circulate air from the building over the evaporator coil to form conditioned air and then push the conditioned air back into the building; and Filters that capture dust, pollen, and other particulate matter from the air before the air is cooled or heated. Other components associated with a cooling process may also be present in the LRTU, such as, by way of example, an Economizer which is an optional component that may be included in an LRTU. The Economizer allows for reduced carbon footprint cooling when outside atmospheric temperatures are appropriate for cooling a building interior by drawing in cool outside air to reduce indoor temperatures.

Heating is accomplished by drawing air from an interior of the building and into the LRTU and passing the air through filters over heating apparatus. The heating apparatus may include one or more electric heating units and gas-fired heating units. Electric heating units include electric resistance devices to warm the air. Gas-fired units provide one or more burners to heat a heat exchanger such that air is warmed as the air passes over and/or through the heat exchanger.

Heating components that may be housed in the LRTU may include one or more: Heat Exchangers (for gas-fired units) with burners to heat air as the air is circulated over the heat exchanger to warm the air; and Burners (for gas-fired units) to produce a flame that heats the heat exchanger.

The LRTU may also encompass Controls, such as one or more of: thermostats, sensors, and controller units. The Controls may be operative to regulate the operation of components with the LRTU based upon desired conditions which may include, for example, one or more of; temperatures, airborne particulates, and humidity.

An LRTU provides significant advantages by reducing roof loading which allows for reduced structural support. Structural support is typically accomplished with a considerable carbon footprint impact, increased costs, and increased time to construct the building. In addition, the LRTU according to the present disclosure provides for optimum space usage since the LRTU is light enough to be located on a roof of a building with relatively low structural support and the LRTU does not require area interior to the building; or occupy ground space.

While the LRTU does not require an area interior to the building, the LRTUs may be assembled with multiple disparate modular components. LRTU's may be manufactured with diverse manufacturing processes including, but not limited to, one or more of: extrusion of synthetic material and bonding to a weather-resistant surface coating; three-dimensional ("3D") printing of one or both of synthetic material and a weather resistant surface coating; and injection molding of synthetic material and bonding to a weather resistant surface coating.

In some embodiments of the apparatus, a method for controlling an HVAC system incorporating an LRTU is developed, focusing on the utilization of advanced sensor technology and environmental condition monitoring to optimize system performance and efficiency.

The method comprises integration of a diverse array of sensors within the LRTU. These sensors are strategically placed to continuously monitor various environmental parameters including indoor and outdoor temperatures, humidity levels, air quality, and pressure. The purpose of this extensive sensor network is to gather detailed real-time data about the environmental conditions both inside and outside the building. This data collection facilitates responsive and efficient operation of the HVAC system.

Temperature sensors play a key role in this system, providing accurate readings of the indoor environment as well as external conditions. These readings enable the LRTU to adjust its heating or cooling output to match the desired indoor temperature set by the occupants, thereby maintaining a comfortable indoor climate.

Humidity sensors add another layer of environmental monitoring, assessing the moisture content in the air. Maintaining optimal humidity levels is essential not only for comfort but also for the health of building occupants and the integrity of the building structure.

Air quality sensors monitor the presence of pollutants and particulates in the indoor air. These sensors ensure that the air quality remains within safe and comfortable levels, triggering the HVAC system to increase ventilation or filtration, as needed.

Pressure sensors within the LRTU monitor the air pressure in different parts of the HVAC system. Proper air pressure balance is helpful for efficient air distribution and for preventing undue stress on the system components. The LRTU may further be equipped with CO2 sensors, ultraviolet (UV) light sensors, and wind speed and direction sensors.

Additionally, this method encompasses remote monitoring capabilities. The sensor data can be transmitted to a centralized control system, which can be accessed by facility managers or maintenance personnel remotely. This feature allows for real-time adjustments to the system settings from off-site locations, enhancing the flexibility and responsiveness of the HVAC management.

Furthermore, the method may include predictive maintenance algorithms that analyze sensor data over time to identify potential issues before they become significant problems. This proactive approach to maintenance facilitates reliable and efficient operation of the LRTU, reducing downtime and extending the lifespan of the system.

Such an LRTU control method represents a sophisticated approach to HVAC system management. By leveraging advanced sensor technology and remote monitoring capabilities, the system not only provides a comfortable and healthy indoor environment but also operates with enhanced efficiency and reliability.

In some embodiments, an LRTU is primarily formed from a synthetic material, such as for example, polypropylene Random Copolymer (PPR) and coated with a weather-resistant surface coating to withstand external environmental conditions to which the LRTU may be exposed to when situated on a building's roof. The housing or cabinet contains all the major components of the HVAC system, protecting the major components from weather, debris, and potential damage. The weather resistant surface coating may include, for example, galvanized steel with a protective coating to resist corrosion.

An LRTU is preferably formed by multiple disparate portions that may be configured to a size and shape specific to deployment suitable for a particular building, or portion of a building. It is noted that in some embodiments, different portions may be manufactured using different modalities of manufacturing processes. For example, larger portions may be extruded PPR onto a thin coating of galvanized steel, and smaller portions of intricate shapes may be injection molded or 3D printed and coated with a metallic coating.

In the design and manufacturing of the LRTU, considerations are given to the practical aspects of transportation and packaging. Portions of the LRTU intended for assembly may be shaped with a focus towards ease of transport via various means such as roadways, railways, and shipping. To facilitate this, these portions are configured to conform to standard shipping container sizes and load capacities, as outlined in ISO 6346. This approach is helpful for efficient and economical transportation of the LRTU components to their installation sites, significantly reducing logistical challenges and costs.

The present disclosure additionally provides for the LRTU to be robust and durable based upon a projected amount of exposure to sun, rain, snow, and other external elements for a given location of deployment. For example, an LRTU to be deployed in a high heat desert environment may include disparate portions suitable for the deployment location and it may be manufactured of materials that are specifically chosen for longevity in high heat, low humidity environments with large temperature variants, and little water intrusion danger. An LRTU to be deployed in a northern location with heavy snow accumulations may have robust waterproofing and be able to support significant weight from snow.

An LRTU may include one or more of the following aspects that may be formed individually and assembled on-site or formed as integrated portions of the LRTU. In some embodiments, an LRTU may be formed and assembled in its entirety, or at least with a majority of aspects included, and transported to a building site and situated in place on or near the building as a single unit. Aspects that may be a part of or incorporated into an LRTU may include, either individually or integrated with other aspects, one or more of:

Access Panels: These are doors or panels that can be opened to access the internal components of the RTU for maintenance, repair, or inspection. They typically have latches or screws and may have seals to prevent water or debris ingress.

Air Intakes and Outlets: Openings or louvers through which air is drawn into or expelled from the unit. Usually covered with screens or grilles to keep out debris, birds, or other pests.

Compartments: The internal space of the RTU housing is often divided into compartments to separate different components and functionalities. Common compartments include:

Cooling compartment: Houses the evaporator coil, blower fan, and associated components.

Heating compartment: Contains the heating elements or burners and heat exchangers.

Compressor compartment: Protects one or more compressors and related refrigeration components. The compressor compresses a refrigerant, raising the temperature and pressure of the refrigerants.

Control compartment: Holds the unit's controls, including circuit boards, relays, and other electrical components.

Base Pan or Mounting Rails: The bottom of the unit, which often has provisions for mounting the RTU securely to the rooftop. May have features to drain away condensation or melting snow and ice.

Sound Attenuation Features: Some modern RTUs incorporate sound-deadening features or materials to reduce operational noise.

Weatherproofing and Insulation: To ensure energy efficiency, the inner walls of the RTU cabinet may be insulated. This insulation helps maintain the desired temperature and reduces energy loss. Weather seals or gaskets may be present around access panels or other openings to prevent water ingress and ensure a snug fit.

Various sensors and controls: For temperature, pressure, air volume, and humidity monitoring.

While the primary function of the RTU housing is to protect the system's components from external elements, it may also be constructed in a size and shape that efficiently manages airflow, allows easy access for maintenance, and minimizes energy losses.

The LRTU may include an Outer Casing that is formed with a synthetic material, such as PPR, (or other plastic) bonded to a weather-resistant protective skin, such as galvanized steel (such as for example galvanized steel or another durable material that is treated to resist corrosion and damage from exposure to the elements). The outer casing provides protection against rain, snow, wind, and other environmental elements. In some embodiments, some or all of the portions of the Outer Casing may be insulated to maintain efficiency, reduce noise, and protect the internal components.

In some preferred embodiments the Outer Casing may include one or more Access Panels (and/or doors) that may be constructed of the same synthetic material and protective skin, or a different composition. For example, while a majority of an LRTU may be formed from a composite of PPR with a galvanized steel protective skin and insulation layer, an access panel may be formed by just galvanized steel and may or may not have an insulation layer. The LRTU may comprise a thermal insulation layer between the PPR layer and the protective layer.

In some embodiments of the present disclosure, Access Panels are removable and/or movable to provide access to the internal components for maintenance, repair, and inspection.

Similarly, some embodiments of the present disclosure include ports or panels providing access to refrigerant lines or other conduits, electrical wires or cabling, consumables (e.g., filters) or other HVAC aspects for servicing, inspection, upgrading, and/or replacement.

A base unit may be included that allows for proper support of the LRTU. The base unit may be standardized, such as for manipulation using a forklift, or of custom design (e.g., constructed of a size, shape, weight, and/or other physical attribute) to be used in a specific setting. In some embodiments, an LRTU may include a relatively flat base that can be readily secured to a rooftop. A base unit may also be provided in a size and shape that facilitates the distribution of an LRTU's mass evenly to prevent damage to the roof.

In addition to protecting the internal components of the RTU, the housing also serves an aesthetic function, presenting a more uniform and polished appearance. In some embodiments, an Outer Casing may be outfitted with one or more electronic sensors that monitor physical conditions and ensure that the LRTU has not experienced conditions that may, or have, led to damage or issues that affect the performance of the LRTU.

An LRTU that is fashioned primarily from PPR will have inherent vibration control characteristics. However, in some embodiments, one or more Vibration Isolators may be included to reduce a transfer of vibrations from the LRTU to the building structure, and/or minimize noise, and wear on the LRTU.

In some embodiments of the present apparatus, air intake and/or exhaust components may be fashioned from the same composite material (or different material compositions) and may include, one or more of: louvers and/or vents that control the flow of one or both of: air intake, and exhaust. Preferably the LRTU provides for air to flow freely while minimizing any entry of rain, snow, and/or debris into the LRTU and the building. An economizer may be included to manage outdoor air intake. The Casing may also include a covered area encompassing and protecting Control and Electrical Components, such as logical, electrical and control apparatus used in the provision of HVAC to the building.

Embodiments that include multiple disparate portions of a Casing are assembled to form an LRTU may also include weatherproofing to protect the inner workings and equipment in the LRTU and prevent damage from weather, moisture, ambient air, and other uncontrolled aspects of an external environment.

In some embodiments of the apparatus, the LRTU includes a Condensate Drain feature. This addition plays a helpful role in managing the condensation that typically accumulates during the cooling process. The Condensate Drain may effectively channel moisture away from the unit, thereby preventing potential water damage to both the LRTU and the building structure. This not only safeguards the unit and the building but also contributes to the efficient and uninterrupted operation of the LRTU. By ensuring proper moisture management, the Condensate Drain aids in maintaining the system's performance and longevity.

The LRTU Casing will house and protect Refrigeration Cycle Components, such as, for example, one or more of: Compressors, Condensers, Expansion Valves, Evaporators, Heat Exchangers, and Burners.

The LRTU Casing may include Air Intakes and Exhausts for air to be drawn into the LRTU (intakes) and, in the case of gas-fired units, flues or exhaust vents to safely expel combustion gases. The Air Intakes and Exhausts will be in fluid communication with Ductwork Connections, such as Supply and Return Ducts which in turn provide fluid communication to conditioned air to and from specific areas within the building.

Additional items that may be housed inside of an LRTU may include one or more of: a Condenser including a coil where the hot, high-pressure refrigerant releases its heat to the ambient air, causing the refrigerant to condense from a vapor to a liquid; an Expansion Valve or TXV (Thermostatic Expansion Valve) to reduce a pressure of the refrigerant, causing it to expand and cool significantly; an Evaporator with a coil where the cold, low-pressure refrigerant absorbs heat from the return air, causing the refrigerant to evaporate into a vapor; a Supply Fan operative to move conditioned air from the RTU into the building's ductwork; a Return Air Fan to draw air from the building and pass it over the evaporator; Filters to remove particulate from the return air before it passes over the evaporator; heating elements or heat exchangers for providing heating.

CONCLUSION

The present apparatus provides roof top units fashioned from alternative materials that are lighter and less energy-intensive to produce compared to traditional materials such as galvanized steel. LRTUs are not only lighter and easier to transport but also require less structural support from the buildings they are installed on. This reduction in weight and structural demand can significantly decrease the energy required for transportation and installation, thereby contributing to a lower carbon footprint.

Furthermore, the integration of sustainable practices in the construction and operation of RTUs can play a critical role in achieving higher LEED certification levels. By utilizing materials that are sourced responsibly, that have a lower environmental impact during production, and that enhance the energy efficiency of the LRTU, builders and developers can accrue points in categories such as Materials and Resources, Energy and Atmosphere, and even Innovation in Design.

Additionally, the present disclosure provides for the adoption of modular design in RTUs, which not only facilitates ease of installation and maintenance but also supports the concept of sustainable construction. Modular units may include multiple disparate portions of a size and shape suitable for disassembly and recycling at the end of their life cycle, aligning with the principles of circular economy. This approach not only reduces waste but also allows for the components to be reused, further contributing to sustainability goals.

By embracing innovative materials, design approaches, and manufacturing processes, an LRTU significantly reduces an associated environmental footprint while still meeting the functional requirements of modern buildings. As such, this shift provides a response to regulatory pressures, and also provides a proactive approach to building a more sustainable future, in line with global environmental and societal goals.

While the apparatus has been described in conjunction with specific embodiments, it is evident that many alternatives, modifications, and variations will be apparent to those skilled in the art in light of the foregoing description. Accordingly, this description is intended to embrace all such alternatives, modifications and variations as fall within its spirit and scope.

The headings utilized in this document serve solely for organizational purposes and should not be interpreted as limiting the scope of either the description or the claims. Throughout this application, the term "may" is employed in a permissive sense, implying the potential for an action or feature, rather than a mandatory sense. Additionally, the words "include," "including," and "includes" are used in an inclusive manner, meaning "including, but not limited to". To aid clarity, similar reference numerals have been used, where feasible, to denote similar elements across different figures.

The expressions "at least one," "one or more," and "and/or" are open-ended and operate both conjunctively and disjunctively. For example, the phrases "at least one of A, B, and C," "at least one of A, B, or C," "one or more of A, B, and C," "one or more of A, B, or C," and "A, B, and/or C" encompass various combinations: A alone, B alone, C alone, A and B, A and C, B and C, or A, B, and C together.

The term "a" or "an" entity implies one or more of that entity. Consequently, the terms "a" (or "an"), "one or more," and "at least one" are used interchangeably in this document. It is also important to note that the terms "comprising," "including," and "having" are used synonymously.

Features described in this specification in the context of separate embodiments can also be integrated into a single embodiment. Conversely, features described within a single embodiment can be implemented in multiple separate embodiments, either alone or in any suitable sub-combination. Furthermore, while certain features may be described and initially claimed in combination, it is possible to remove one or more features from the combination, resulting in a claimed sub-combination or variation thereof.

Although method steps may be illustrated in a specific order, this should not be construed as a requirement that these operations must be performed in the depicted order or sequentially, nor that all illustrated operations are necessary for achieving the desired outcomes.

The separation of system components in the described embodiments is not mandatory for all embodiments. The components and systems described can typically be integrated into a single product or distributed across multiple products. Therefore, while specific embodiments have been detailed, other embodiments fall within the scope of the appended claims. In some instances, the actions recited in the claims can be performed in a different order and still yield desirable results. Moreover, the methods, systems or apparatuses shown in the accompanying figures do not necessarily require the depicted order or sequential progression to achieve beneficial outcomes. In certain implementations, selective arrangements may prove beneficial. However, it should be understood that various modifications can be made without departing from the spirit and scope of the claimed disclosure.

What is claimed is:

1. A Roof Top Unit (RTU) for containing Heating, Ventilation, and Air Conditioning (HVAC) components, the RTU comprising:

a Polypropylene Random Copolymer (PPR) core layer comprising a size and shape capable of providing protection of the HVAC components from environmental conditions, the PPR core layer defining a primary exterior casing of the RTU as a plurality of detachable exterior modular casing panels;

each of the plurality of detachable exterior modular casing panels comprising the PPR core layer bonded to at least one protective layer affixed to the PPR core layer;

a plurality of exterior modular casing panels configured for assembly into a size and shape to form a weather-exposed housing around the HVAC components capable of providing protection of the HVAC components from the environmental conditions; and an integrated control system with at least one sensor for monitoring and regulating one or more of: temperature, pressure, air volume, and humidity.

2. The RTU of claim 1, wherein the at least one protective layer is a metallic layer, comprising materials selected from aluminum, galvanized steel, or combinations thereof.

3. The RTU of claim 1, wherein the at least one protective layer comprises one of: a non-metallic UV-resistant polymer and a high-grade impervious plastic material.

4. The RTU of claim 1, wherein the at least one protective layer comprises a nanocomposite coating.

5. The RTU of claim 1, wherein the RTU comprises a first protective layer affixed to a first side of the PPR core layer, and a second protective layer affixed to a second side of the PPR core layer, forming a sandwich structure with the PPR core layer, wherein the first side of the PPR core layer is opposite to the second side of the PPR core layer.

6. The RTU of claim 5, wherein the second protective layer comprises a different material than the first protective layer.

7. The RTU of claim 1, wherein the PPR core layer is configured as structural, load-bearing sandwich enclosure panels for a building rooftop unit, each panel having protective layers on opposite sides, the panels joinable via integrated interlocking edge connectors to form a weather-sealed housing and the RTU further comprising an economizer for utilizing outside air to control indoor temperatures.

8. The RTU of claim 7, wherein the at least one sensor comprises one or more of: a temperature sensor, a pressure sensor, a humidity sensor, and an air-quality sensor.

9. The RTU of claim 8, further comprising a damper for operating in one of both of: a damper open mode and a damper closed mode.

10. The RTU of claim 7, wherein the integrated control system is configured to communicate with a building management system.

11. The RTU of claim 1, further comprising a condensate drain to manage moisture from a cooling process, the condensate drain comprising a molded conduit integrated within the PPR core layer and sealed to the first and second protective layer(s), the molded conduit having a hydrophobic nano-coated interior surface to promote drainage and prevent moisture retention, and terminating at an exterior discharge port of the RTU casing.

12. The RTU of claim 7, further comprising one or both of: integrated solar panels for auxiliary power generation and a rainwater harvesting system.

13. The RTU of claim 1, wherein the RTU comprises a continuous arcuate tubular shell defining a cylindrical or elliptical cross-section along an axis, the continuous arcuate tubular shell lacking planar exterior panels.

14. The RTU of claim 1, further comprising a thermal insulation system adaptable to varying climatic conditions by configurations to vary thermal resistance responsive to sensed ambient conditions via the integrated control system.

15. The RTU of claim 1, further comprising a sound attenuation system within the at least one protective layer to reduce operational noise.

16. The RTU of claim 1, further comprising a vibration damping mechanism comprising a dedicated elastomeric isolation interlayer disposed between the PPR core layer and the first and second protective layer to minimize transmission of vibrations to building structure.

17. The RTU of claim 7, further comprising a smart control system capable of wireless connectivity for remote monitoring and control.

18. The RTU of claim 1, wherein the at least one protective layer comprises a self-cleaning surface comprising a hydrophobic nano-coating applied to a metallic protective layer of the RTU housing to reduce maintenance requirements.

19. The RTU of claim 1, further comprising a thermal insulation layer comprising a continuous bonded interlayer disposed between, and adhered to, the PPR core layer and the at least one protective layer.

20. The RTU of claim 1, wherein the plurality of modular components comprises detachable panels for easy access to internal parts for maintenance and repair.

21. The RTU of claim 1, wherein the plurality of modular components comprise tool-less snap-fit or interlocking connectors for quick assembly and disassembly, facilitating efficient installation and servicing.

22. The RTU of claim 21, wherein the plurality of modular components are interconnectable via the tool-less snap-fit or interlocking connectors to permit field reconfiguration to suit roof footprints and penetrations, allowing for customization of the RTU, based on specific building requirements.

* * * * *